US008037929B2

(12) United States Patent
Higashiyama

(10) Patent No.: US 8,037,929 B2
(45) Date of Patent: Oct. 18, 2011

(54) EVAPORATOR

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 1088 days.

(21) Appl. No.: 11/722,044

(22) PCT Filed: Dec. 7, 2005

(86) PCT No.: PCT/JP2005/022904

§ 371 (c)(1),
(2), (4) Date: Jun. 18, 2007

(87) PCT Pub. No.: WO2006/064823

PCT Pub. Date: Jun. 22, 2006

(65) Prior Publication Data

US 2009/0282850 A1 Nov. 19, 2009

Related U.S. Application Data

(60) Provisional application No. 60/637,745, filed on Dec. 22, 2004.

(30) Foreign Application Priority Data

Dec. 16, 2004 (JP) ..... 2004-363859

(51) Int. Cl.
*F28F 1/10* (2006.01)
*F28F 9/02* (2006.01)
*B60H 1/00* (2006.01)

(52) U.S. Cl. ..... 165/153; 165/152; 165/172; 165/174; 165/175; 29/890.03; 62/515

(58) Field of Classification Search ..... 165/41, 165/152, 153, 172, 173, 174, 175; 62/244, 62/515; 29/890.03
See application file for complete search history.

(56) References Cited

U.S. PATENT DOCUMENTS 4,353,224 A * 10/1982 Nonogaki et al. ..... 165/152

(Continued)

FOREIGN PATENT DOCUMENTS

JP 5 149649 6/1993

(Continued)

OTHER PUBLICATIONS

U.S. Appl. No. 11/576,649, filed Apr. 4, 2007, Higashiyama, et al.*

(Continued)

*Primary Examiner* — Ljiljana Ciric
(74) *Attorney, Agent, or Firm* — Oblon, Spivak, McClelland, Maier & Neustadt, L.L.P.

(57) ABSTRACT

An evaporator includes plural refrigerant flow members and corrugate fins disposed in corresponding air-passing clearances between the adjacent refrigerant flow members. Each refrigerant flow member includes plural flat tubes arranged in the front-rear direction. Each corrugate fin extends across all the flat tubes. A vertically extending drain portion is formed between the flat tubes adjacent each other in the front-rear direction. At each connection portion of the corrugate fin, a louver group including plural louvers inclining downward toward the front is provided to correspond to a front portion of each flat tube. At least the front-end louver of the louver group provided to correspond to the front portion of each flat tube except for the flat tube at the front end is located in the drain portion.

11 Claims, 13 Drawing Sheets

U.S. PATENT DOCUMENTS

| | | | | |
|---|---|---|---|---|
| 4,580,624 | A * | 4/1986 | Ishida et al. | 165/152 |
| 4,982,579 | A * | 1/1991 | Suzuki et al. | 62/515 |
| 5,289,874 | A * | 3/1994 | Kadle et al. | 165/152 |
| 5,311,935 | A * | 5/1994 | Yamamoto et al. | 165/152 |
| 5,443,116 | A * | 8/1995 | Hayashi et al. | 165/153 |
| 6,161,616 | A * | 12/2000 | Haussmann | 165/152 |
| 6,308,527 | B1 * | 10/2001 | Kuroyanagi et al. | 62/515 |
| 6,439,300 | B1 * | 8/2002 | Falta et al. | 165/152 |
| 6,907,919 | B2 * | 6/2005 | Zhang | 165/152 |
| 6,938,684 | B2 * | 9/2005 | Iwasaki | 29/890.03 |
| 2007/0251681 | A1 * | 11/2007 | Higashiyama et al. | 165/153 |

FOREIGN PATENT DOCUMENTS

| | | |
|---|---|---|
| JP | 5-180533 | 7/1993 |
| JP | 6 74865 | 10/1994 |
| JP | 10 141805 | 5/1998 |
| JP | 2000-179988 | 6/2000 |
| JP | 2001-255039 | 9/2001 |
| JP | 2001 255039 | 9/2001 |
| JP | 2001-255091 | 9/2001 |
| JP | 2001 289536 | 10/2001 |
| JP | 2002-81795 | 3/2002 |
| JP | 2003-75024 | 3/2003 |
| JP | 2003-214794 | 7/2003 |
| JP | 2004 11957 | 1/2004 |
| JP | 2004-170061 | 6/2004 |

OTHER PUBLICATIONS

Japanese Office Action issued Jul. 20, 2010, in Patent Application No. 2005-361219.

* cited by examiner

EVAPORATOR

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/637,745 filed Dec. 22, 2004 pursuant to 35 U.S.C. §111(b).

TECHNICAL FIELD

The present invention relates to an evaporator to be built in, for example, a car air conditioner.

Herein and in the appended claims, the upper and lower sides of FIGS. 1, 2, and 10 will be referred to as "upper" and "lower," respectively. The downstream side of an air flow (a side represented by arrow X in FIGS. 1 and 10, and a right-hand side in FIG. 4) is referred to as the "front," and the opposite side as the "rear." The left-hand and right-hand sides of FIGS. 2 and 10 will be referred to as "left" and "right," respectively.

BACKGROUND ART

A conventionally used evaporator for use in a car air conditioner includes a plurality of refrigerant flow members arranged in parallel, and corrugate fins each disposed between and brazed to the adjacent refrigerant flow members. Each of the corrugate fins includes wave crest portions, wave trough portions, and horizontal connection portions connecting together the wave crest portions and the wave trough portions. The wave crest portions and the wave trough portions are brazed to the refrigerant flow members. A plurality of louvers are formed in the connection portions in such a manner as to be juxtaposed in the air flow direction.

In the evaporator, a portion of condensed water on the surface of the refrigerant flow members and on the surface of the corrugate fins flows downward through openings between adjacent louvers. The residual condensed water flows, by the effect of surface tension, toward joint portions between the refrigerant flow members and the wave crest portions of the corrugate fins and toward joint portions between the refrigerant flow members and the wave trough portions of the corrugate fins. Then, the residual condensed water flows, by the effect of the flowing air, in the air flow direction and flows downward along the front ends of the refrigerant flow members. However, in the case where the quantity of condensed water is large, a large quantity of condensed water stagnates at the joint portions, and is not drained sufficiently from the front-end side, which raises a problem in that when the flow rate of air abruptly changes, the condensed water scatters, or the condensed water closes the clearances between louvers by means of surface tension to thereby lower cooling performance. Moreover, the condensed water may freeze.

An evaporator in which the above problem is solved has been proposed. In the evaporator, a corrugate fin disposed between adjacent flat tubes is divided into a plurality of separate fin members, which are arranged at predetermined intervals in the air flow direction. A clearance is formed between the adjacent separate fin members. Drain grooves for draining condensed water are formed on the outer surface of the flat tubes at positions corresponding to the clearances. (Such an evaporator is proposed in, for example, Japanese Patent Application Laid-Open (kokai) No. 10-141805.)

However, in the evaporator described in the above-mentioned publication, each of the corrugate fins is divided into a plurality of separate fin members, which are arranged at predetermined intervals in the air flow direction, and a clearance is formed between the adjacent separate fin members. This, in manufacture of the evaporator, raises a problem that assembling together the refrigerant flow members and the separate fin members is troublesome. Also, as compared with an undivided corrugate fin, the divided corrugate fin is smaller in the area of heat transfer with air that flows through an air-passing clearance between adjacent refrigerant flow members, thus raising a problem of an impairment in heat-exchanging performance.

An object of the present invention is to solve the above problem and to provide an evaporator which exhibits excellent drainage of condensed water and enables high work efficiency in manufacture thereof.

DISCLOSURE OF THE INVENTION

According to one aspect of the present invention, an evaporator has refrigerant flow members arranged in parallel at predetermined intervals in a left-right direction, and corrugate fins disposed in corresponding air-passing clearances between the adjacent refrigerant flow members.

Each refrigerant flow member includes refrigerant flow tube portions arranged in a front-rear direction; each corrugate fin is disposed to extend across all the refrigerant flow tube portions; a vertically extending drain portion is formed between the refrigerant flow tube portions adjacent each other in the front-rear direction; and each corrugate fin includes wave crest portions, wave trough portions, and connection portions connecting together the wave crest portions and the wave trough portions and each having a plurality of louvers arranged in the front-rear direction. At each connection portion of the corrugate fin, a louver group composed of louvers inclining downward toward the front is provided to correspond to a front portion of each refrigerant flow tube portion of the refrigerant flow member, and at least the front-end louver of the louver group provided to correspond to the front portion of each refrigerant flow tube portion except for the refrigerant flow tube portion at the front end is located in the drain portion of the refrigerant flow member.

In the evaporator, at each connection portion of the corrugate fin, a second louver group composed of louvers inclining upward toward the front is formed to correspond to a rear portion of each refrigerant flow tube portion of the refrigerant flow member.

In the evaporator, each corrugate fin may have a fin height of 7.0 mm to 10.0 mm and a fin pitch of 1.3 mm to 1.8 mm.

In the evaporator, each of the wave crest portions and the wave trough portions of each corrugate fin may have a flat portion and round portions located at corresponding opposite ends of the flat portion and connected to the corresponding connection portions; and the round portions have a radius of curvature of 0.7 mm or less.

In the evaporator, tube groups may be arranged in rows at predetermined intervals in the front-rear direction, each tube group made of flat tubes may be arranged in parallel at predetermined intervals in the left-right direction; and flat tubes arranged in tandem in the front-rear direction may constitute a single refrigerant flow member; each flat tube serves as a refrigerant flow tube portion; the corrugate fins may be brazed to the flat tubes; and a clearance between the flat tubes adjacent each other in the front-rear direction serves as the drain portion.

The evaporator may include a refrigerant inlet header section which is disposed on a side toward the front and on a first-end side of the refrigerant flow members and to which the flat tubes of at least a single tube group are connected; a refrigerant outlet header section which is disposed on the first-end side of the refrigerant flow members and rearward of the refrigerant inlet header section and to which the flat tubes of the remaining tube groups are connected; a first intermediate header section which is disposed on the side toward the front and on a second-end side of the refrigerant flow members and to which the flat tubes connected to the refrigerant inlet header section are connected; and a second intermediate header section which is disposed on the second-end side of the refrigerant flow members and rearward of the first intermediate header section and to which the flat tubes connected to the refrigerant outlet header section are connected, wherein the first and second intermediate header sections communicate with each other.

In the evaporator, the first and second intermediate header sections may be integrated.

In the evaporator, a drain gutter extending in the left-right direction may be provided on the upper surface of a portion between the first and second intermediate header sections at a location corresponding to the drain portion.

In the evaporator, a tube height, which is the thickness of the individual flat tubes as measured in the left-right direction, may be 0.75 mm to 1.5 mm.

In the evaporator, each of the refrigerant flow members may be formed of two metal plates whose peripheral edge portions are joined together; bulging refrigerant flow tube portions arranged in the front-rear direction may be formed between the two metal plates, and a bulging header formation portion may be connectedly formed at each of opposite ends of the bulging refrigerant flow tube portions; the refrigerant flow members may be laminated such that their bulging header formation portions abut each other and such that air-passing clearances are formed between the bulging refrigerant flow tube portions; and a corrugate fin may be disposed in each air-passing clearance between adjacent refrigerant flow members and brazed to the refrigerant flow members.

In the evaporator, the drain portion between the refrigerant flow tube portions adjacent each other in the front-rear direction may include a groove formed by inwardly deforming the two metal plates that constitute the corresponding refrigerant flow member.

In the evaporator, a tube portion height, which is the thickness of the bulging refrigerant flow tube portion as measured in the left-right direction, may be 0.75 mm to 1.5 mm.

A refrigeration cycle including a compressor, a condenser, and an evaporator, and using a chlorofluorocarbon-based refrigerant, may have the evaporator.

A vehicle having installed therein the refrigeration cycle as a car air conditioner.

A supercritical refrigeration cycle which includes a compressor, a gas cooler, an evaporator, a pressure-reducing device, and an intermediate heat exchanger for performing heat exchange between a refrigerant from the gas cooler and a refrigerant from the evaporator and in which a supercritical refrigerant is used, may have the evaporator.

A vehicle having installed therein the refrigeration cycle as a car air conditioner.

With the evaporator, each refrigerant flow member includes refrigerant flow tube portions arranged in the front-rear direction, and each corrugate fin is disposed to extend across all the refrigerant flow tube portions. Therefore, in contrast to the case of the corrugate fins of the evaporator described in the above-mentioned publication in which each of the corrugate fins is divided into a plurality of separate fin members in the air flow direction, the work of combining the refrigerant flow members and the corrugate fins in manufacture of the evaporator can be easily performed. In addition, a reduction in the area of heat transfer between the corrugate fins and the air flowing through air-passing clearances between adjacent refrigerant flow members is suppressed, and thus a drop in cooling performance of the evaporator is prevented. Further, at each connection portion of the corrugate fin, a louver group composed of a plurality of louvers inclining downward toward the front is formed to correspond to a front portion of each refrigerant flow tube portion of the refrigerant flow member, and at least the front-end louver of the louver group provided to correspond to the front portion of each refrigerant flow tube portion except for the refrigerant flow tube portion at the front end is located in the drain portion of the refrigerant flow member. Therefore, the condensed water produced on the refrigerant flow members and on the surface of each corrugate fin can be drained in an improved manner. That is, the condensed water produced on the refrigerant flow members and on the surface of each corrugate fin mostly flows, by the capillary effect, toward joint portions between the refrigerant flow members and the wave crest portions of the corrugate fins and toward joint portions between the refrigerant flow members and the wave trough portions of the corrugate fins, then flows forward along the joint portions because of air passing through the air-passing clearances. Subsequently, the water flows downward along the front end surface of the refrigerant flow tube portion at the front end, and also flows along a portion, facing the drain portion, of the front end surface of each of the remaining refrigerant flow tube portions. However, in the case where at least the front-end louver of the louver group provided to correspond to the front portion of each refrigerant flow tube portion except for the refrigerant flow tube portion at the front end is not located in the drain portion of the refrigerant flow member, the condensed water may flow frontward while passing through the drain portion along portions of the connection portions of the corrugate fin where the louvers are not formed, which may result in a drop in draining performance when the quantity of the produced condensed water is large. In contrast, in the case where at least the front-end louver of the louver group provided to correspond to the front portion of each refrigerant flow tube portion except for the refrigerant flow tube portion at the front end is located in the drain portion of the refrigerant flow member, the condensed water flows downward through a clearance between one louver located in the drain portion of the refrigerant flow member and another louver adjacently located on the rear side thereof. Therefore, the condensed water produced on the surface of the corrugate fin is prevented from flowing forward while passing through the drain portion. In addition, at each connection portion of the corrugate fin, a louver group composed of a plurality of louvers inclining downward toward the front is formed to correspond to a front portion of each refrigerant flow tube portion of the refrigerant flow member. Therefore, at this portion, air passes through the clearances between the louvers downward, so that water in the drain portion is led downward, whereby downward drain of water from the drain portion is performed in an improved manner. Accordingly, a drop in the draining performance is prevented even when the quantity of produced condensed water is large.

With the evaporator, while an increase of air flow resistance is suppressed, heat exchange performance is enhanced, thereby establishing good balance between air flow resistance and heat exchange performance.

With the evaporator, the quantity of condensed water collected on the joint portions between the refrigerant flow members and the wave crest portions and on the joint portions between the refrigerant flow members and the wave trough portions tends to increase. However, even in this case, employment of the configuration of par. 1) enhances drainage of condensed water.

With the evaporator, the drain gutter receives condensed water which flows downward along a portion, facing the drain portion, of the front end surface of each refrigerant flow tube portion except for the refrigerant flow tube portion at the front end, as well as condensed water which flows downward through the clearance between one louver located in the drain portion of the refrigerant flow member and another louver adjacently located on the rear side thereof.

With the evaporator, while an increase of air flow resistance is suppressed, heat exchange performance is enhanced, thereby establishing good balance between air flow resistance and heat exchange performance.

With the evaporator, while an increase of air flow resistance is suppressed, heat exchange performance is enhanced, thereby establishing good balance between air flow resistance and heat exchange performance.

BEST MODE FOR CARRYING OUT THE INVENTION

Embodiments of the present invention will next be described in detail with reference to the drawings. The embodiments are of an evaporator according to the present invention that is applied to an evaporator of a car air conditioner using a chlorofluorocarbon-based refrigerant.

Embodiment 1

The present embodiment is illustrated in FIGS. 1 to 9.

Figure 1:
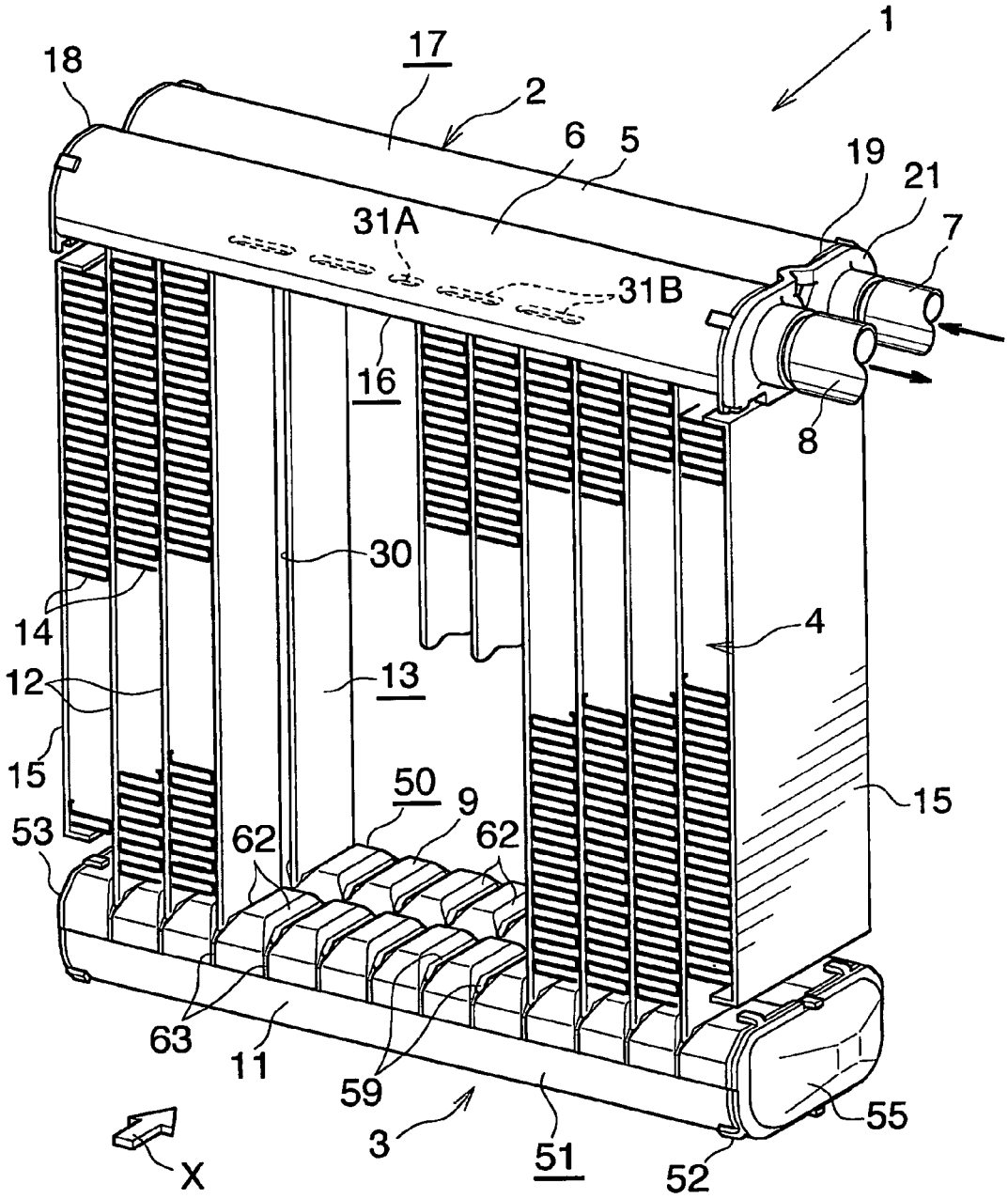
FIG. 1 is a partially cut-away perspective view showing the overall configuration of Embodiment 1 of an evaporator according to the present invention.
Figure 2:
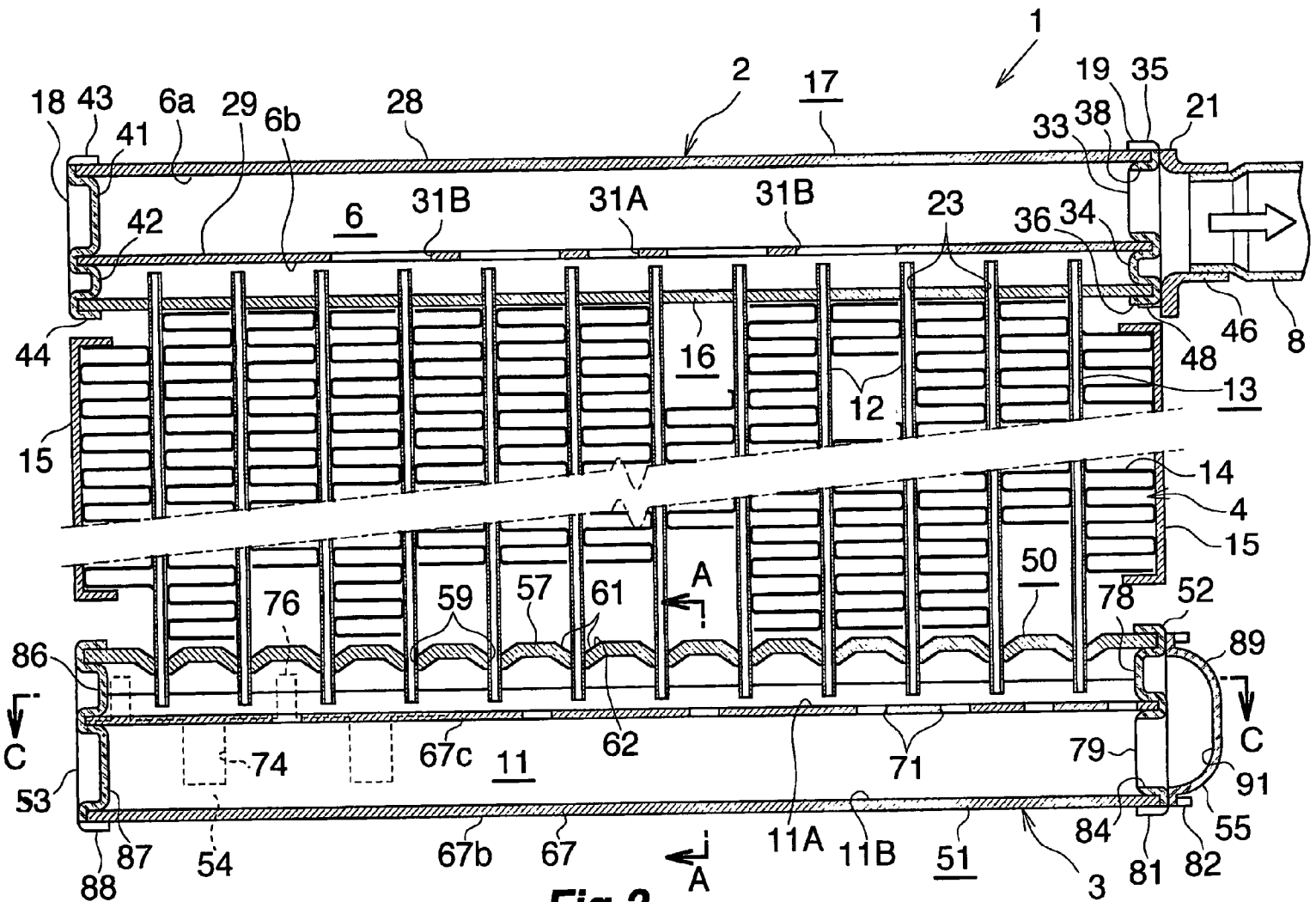
FIG. 2 is a fragmentary view in vertical section showing the evaporator shown in FIG. 1 as it is seen from the rear, with its intermediate portion omitted.
Figure 9:
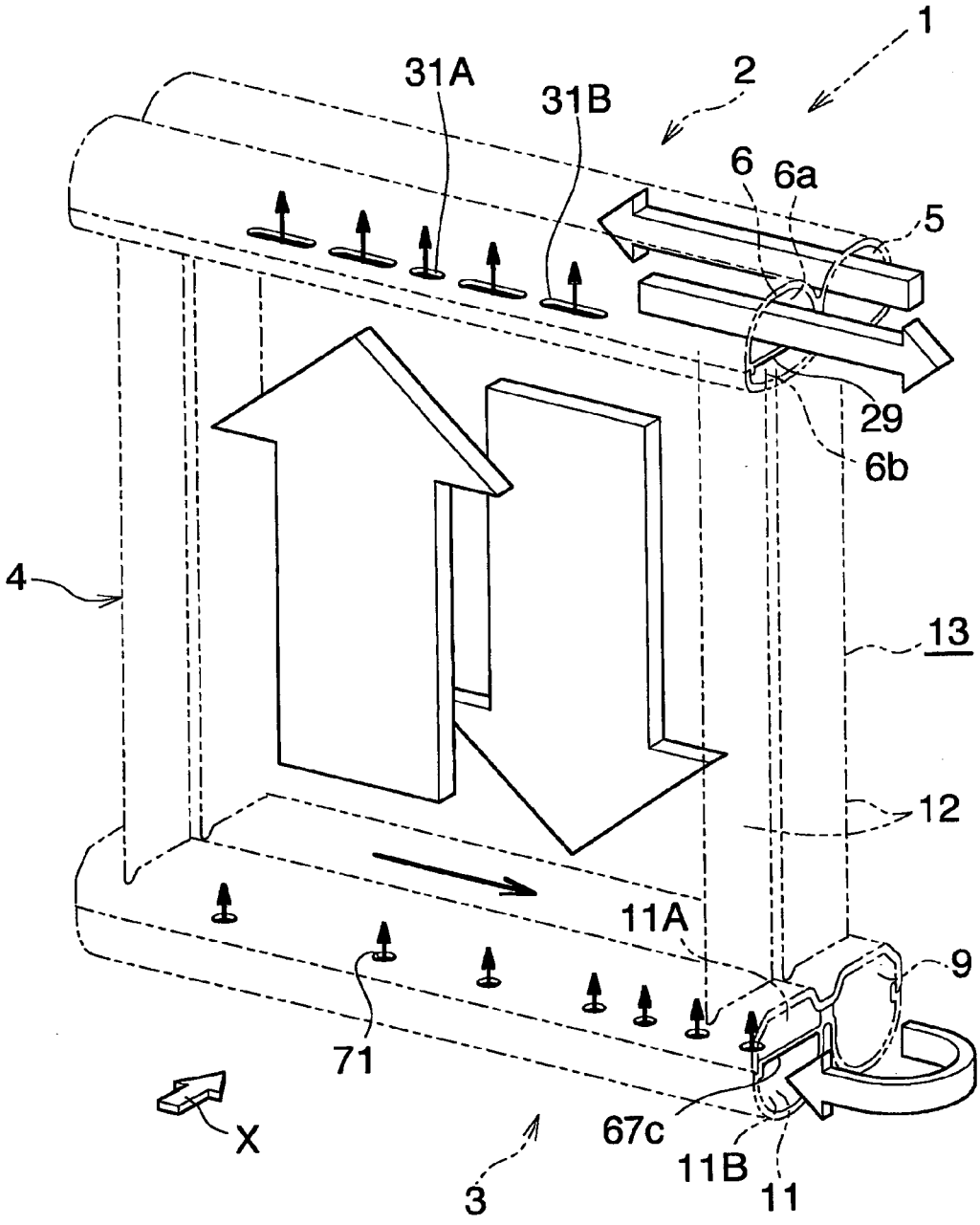
FIG. 9 is a diagram showing the flow of a refrigerant in the evaporator shown in FIG. 1.
Figure 10:
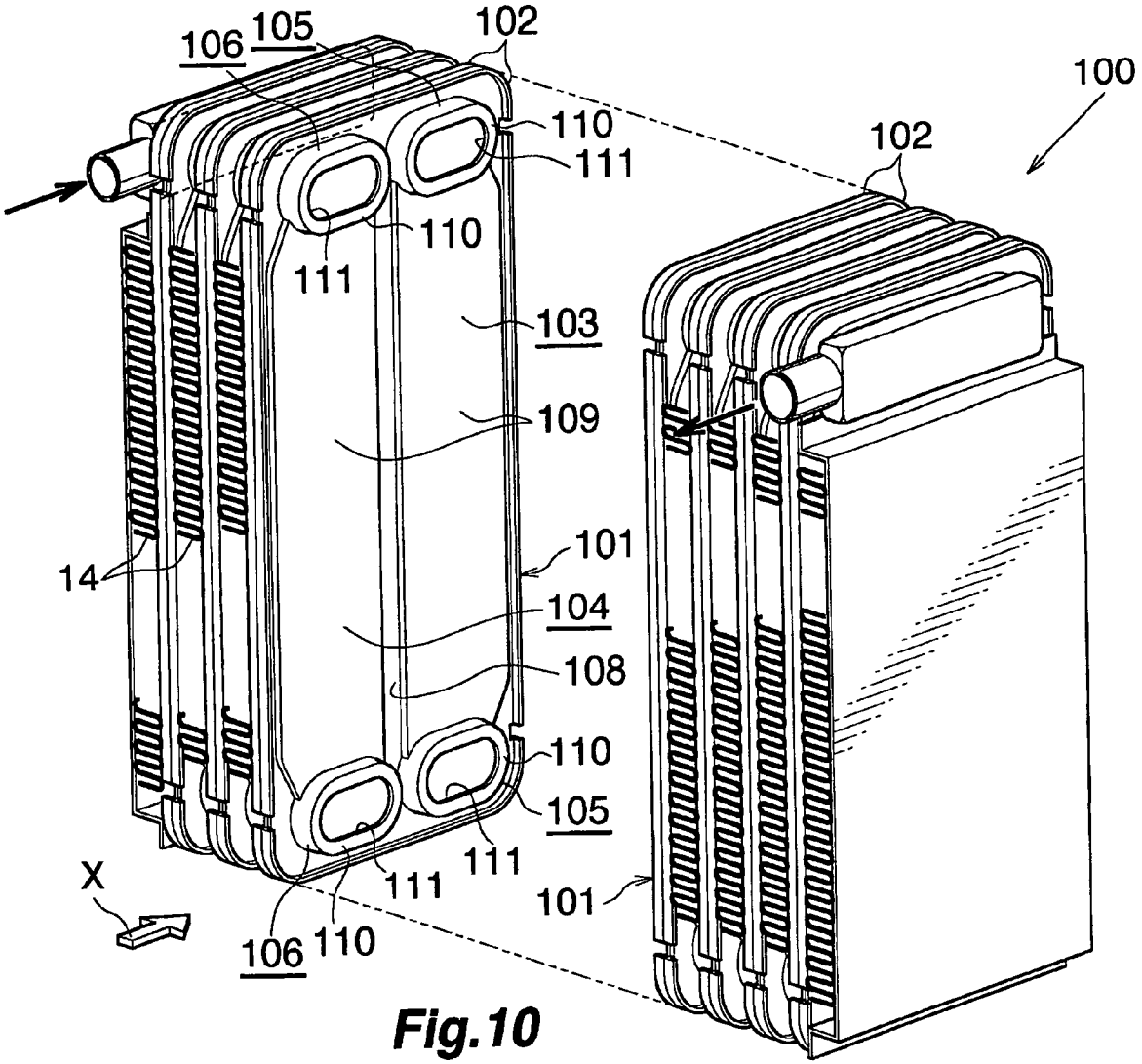
FIG. 10 is a partially omitted perspective view showing the overall configuration of Embodiment 2 of the evaporator according to the present invention.
Figure 11:
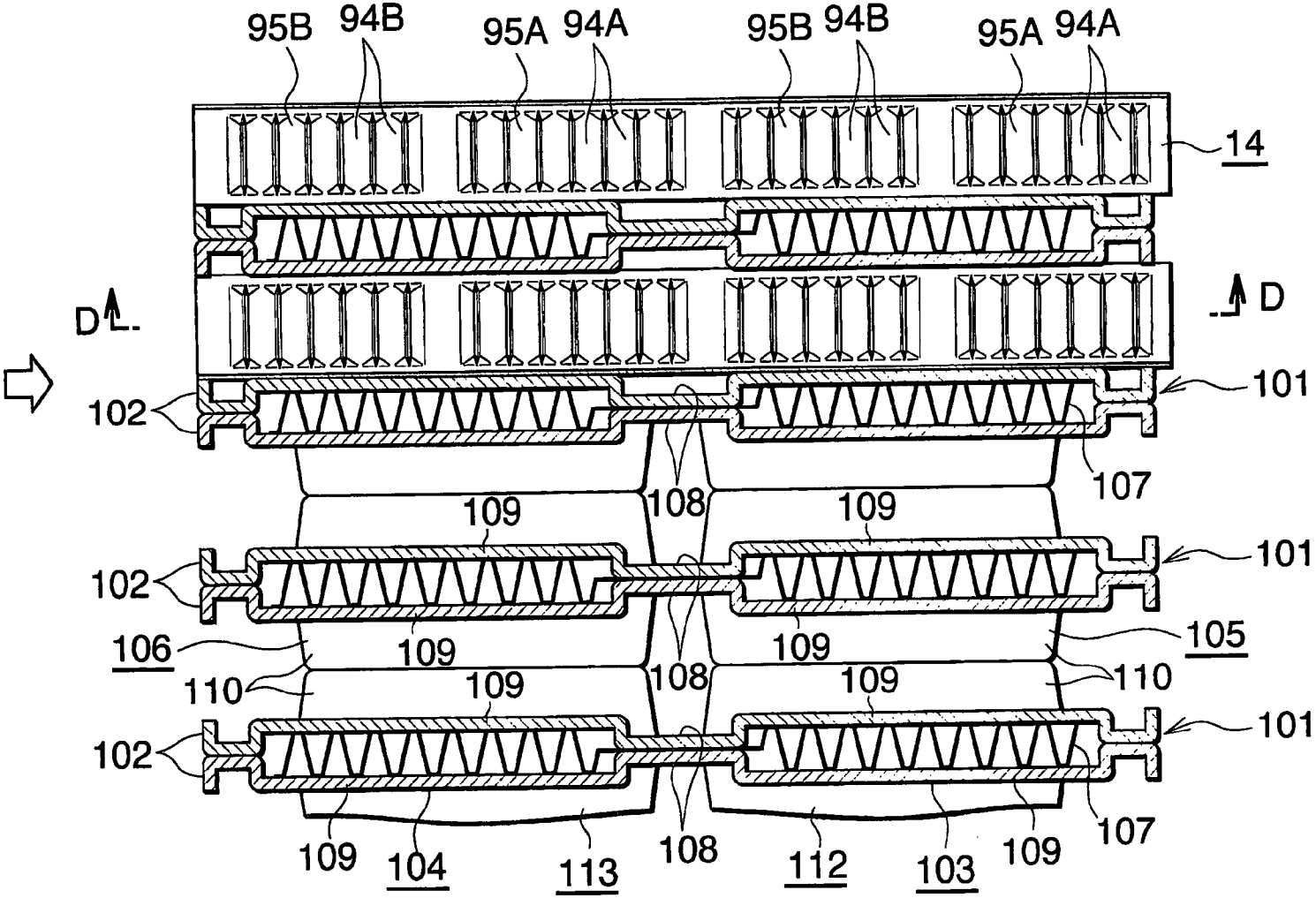
FIG. 11 is a partially omitted, partial enlarged horizontal cross section of the evaporator shown in FIG. 10.
Figure 12:
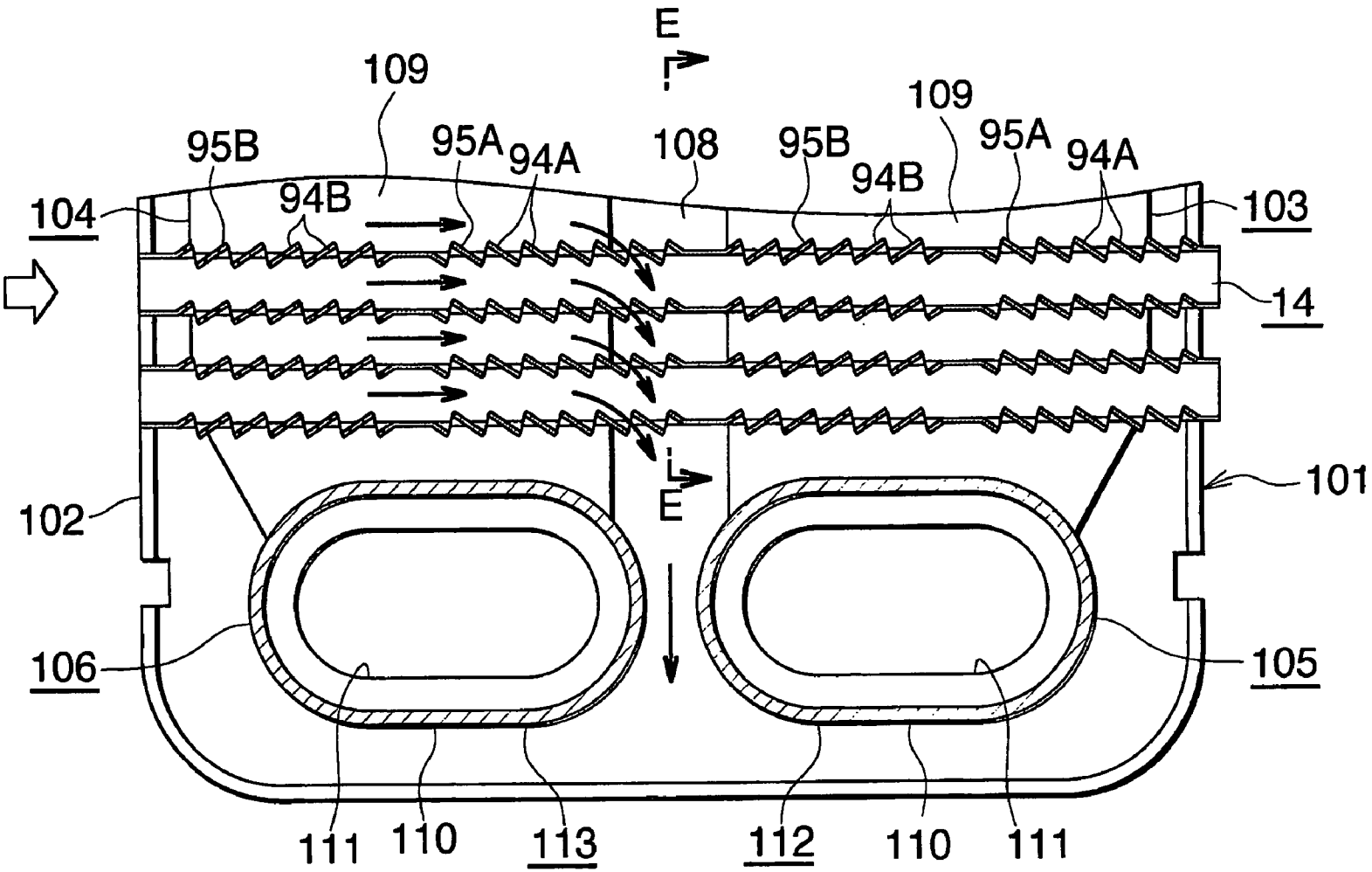
FIG. 12 is a sectional view taken along line D-D of FIG. 11.
Figure 13:
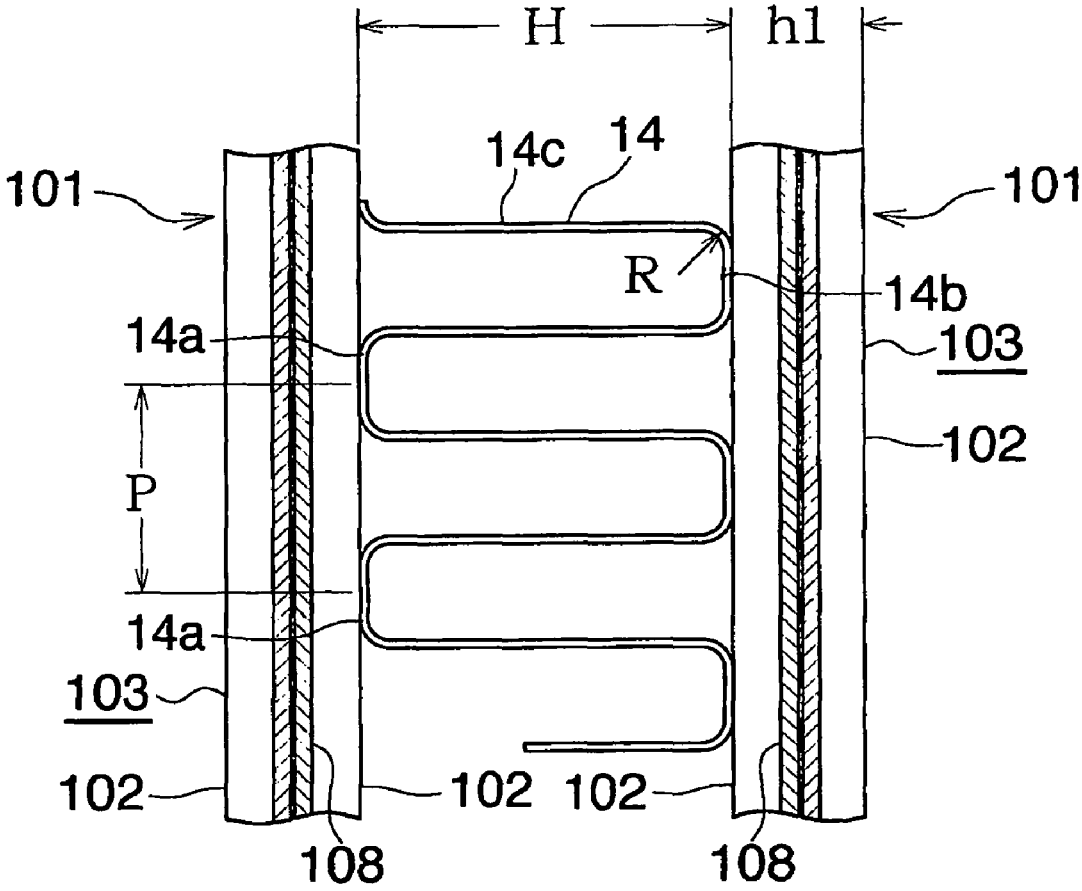
FIG. 13 is a fragmentary view in section taken along line E-E of FIG. 11.

FIGS. 1 and 2 show the overall configuration of an evaporator, and FIGS. 3 to 8 show the configuration of essential portions of the evaporator. FIG. 9 shows how a refrigerant flows in the evaporator.

In FIGS. 1 and 2, the evaporator (1), which is used in a car air conditioner using a chlorofluorocarbon-based refrigerant, includes a refrigerant inlet/outlet tank (2) made of aluminum and a refrigerant turn tank (3) made of aluminum, the tanks (2) and (3) being vertically spaced apart from each other, and further includes a heat exchange core section (4) provided between the tanks (2) and (3).

The refrigerant inlet/outlet tank (2) includes a refrigerant inlet header section (5) located on a side toward the front (downstream side with respect to the air flow direction) and a refrigerant outlet header section (6) located on a side toward the rear (upstream side with respect to the air flow direction). A refrigerant inlet pipe (7) made of aluminum is connected to the refrigerant inlet header section (5) of the refrigerant inlet/outlet tank (2). A refrigerant outlet pipe (8) made of aluminum is connected to the refrigerant outlet header section (6).

The refrigerant turn tank (3) includes a refrigerant inflow header section (9) (first intermediate header section) located on the side toward the front and a refrigerant outflow header section (11) (second intermediate header section) located on the side toward the rear. A connection section (10) connects the header sections (9) and (11) together for integration. The header sections (9) and (11) and the connection section (10) define a drain gutter (20) (see FIG. 4).

The heat exchange core section (4) includes a plurality of refrigerant flow members (13) arranged in parallel at predetermined intervals in the left-right direction; corrugate fins (14) made of aluminum, disposed within air-passing clearances between the adjacent refrigerant flow members (13) and on the outer sides of the leftmost and rightmost refrigerant flow members (13), and brazed to the refrigerant flow members (13); and side plates (15) made of aluminum, disposed outer sides of the leftmost and rightmost corrugate fins (14), and brazed to the corresponding corrugate fins (14). Each of the refrigerant flow members (13) includes a plurality of; herein, two, flat tubes (12) (refrigerant flow tube portions) made from an aluminum extrudate and disposed at predetermined intervals in the front-rear direction such that their widths extend in the front-rear direction. The upper and lower ends of the front flat tube (12) are connected to the refrigerant inlet header section (5) and the refrigerant inflow header section (9), respectively, whereas the upper and lower ends of the rear flat tube (12) are connected to the refrigerant outlet header section (6) and the refrigerant outflow header section (11), respectively. The clearance between the flat tubes (12) of each refrigerant flow member (13) adjacently located in the front-rear direction serves as a drain portion (30).

Figure 3:
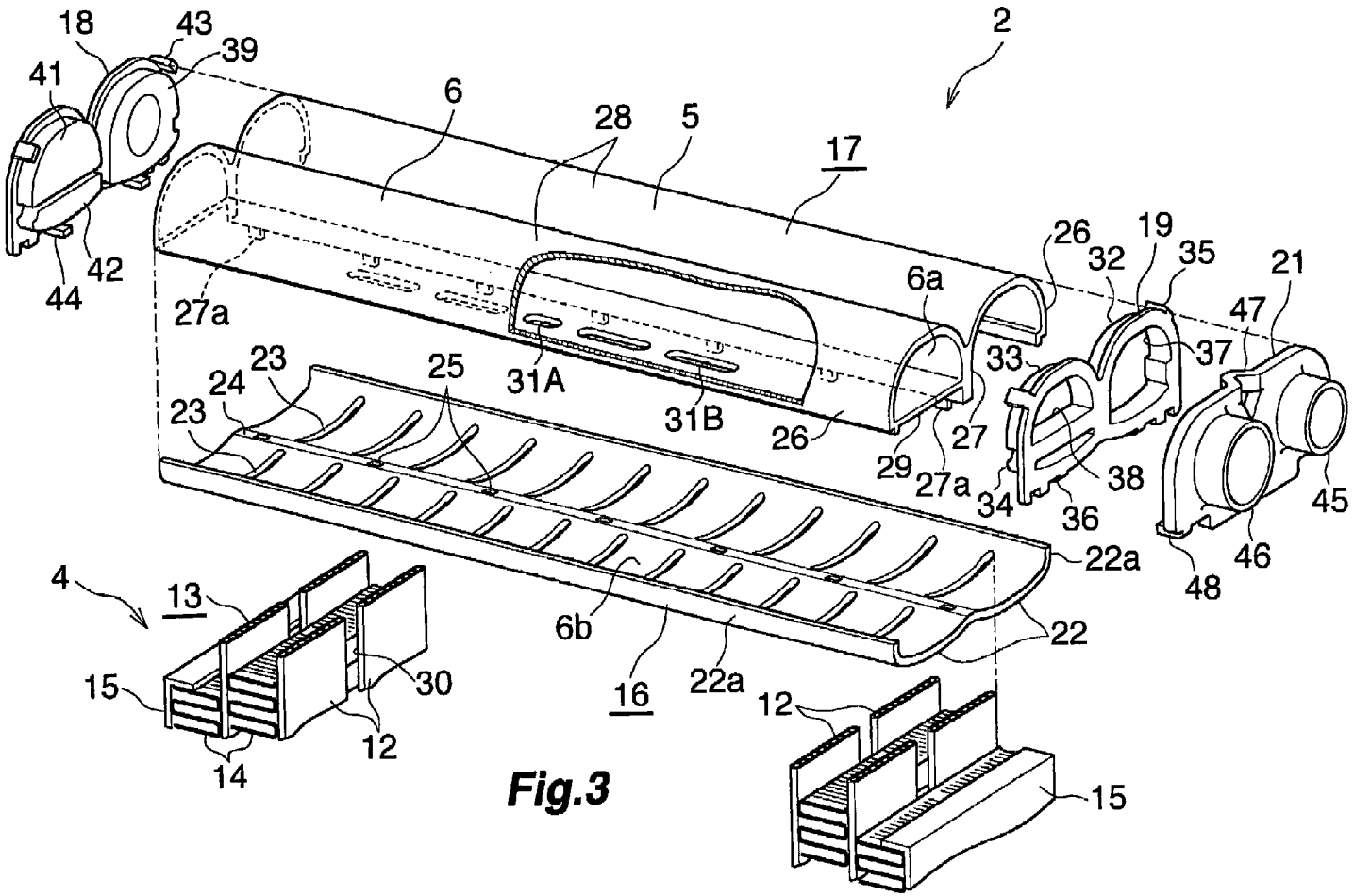
FIG. 3 is an exploded perspective view of a refrigerant inlet/outlet tank of the evaporator shown in FIG. 1.
Figure 4:
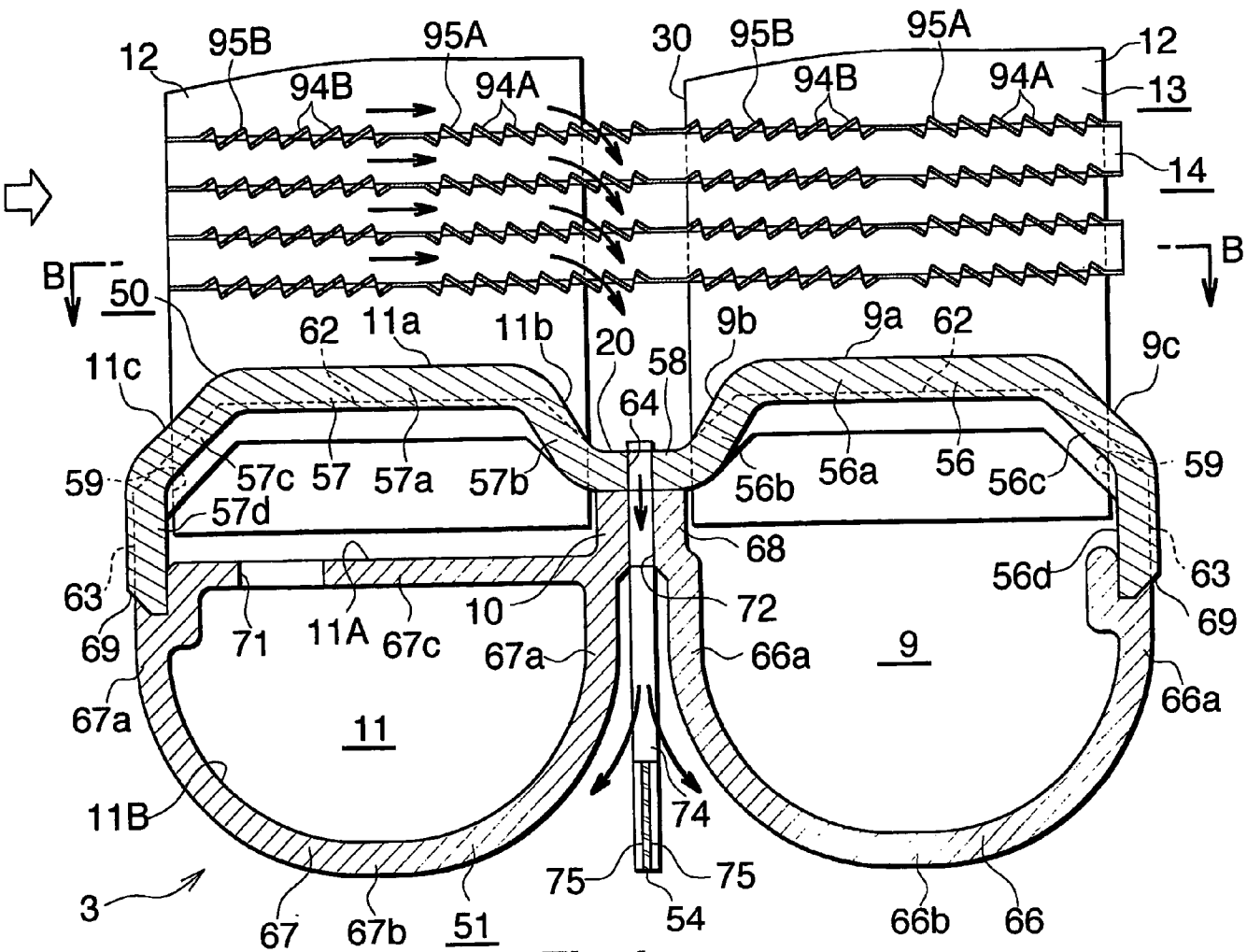
FIG. 4 is an enlarged fragmentary view in section taken along line A-A of FIG. 2.
Figure 5:
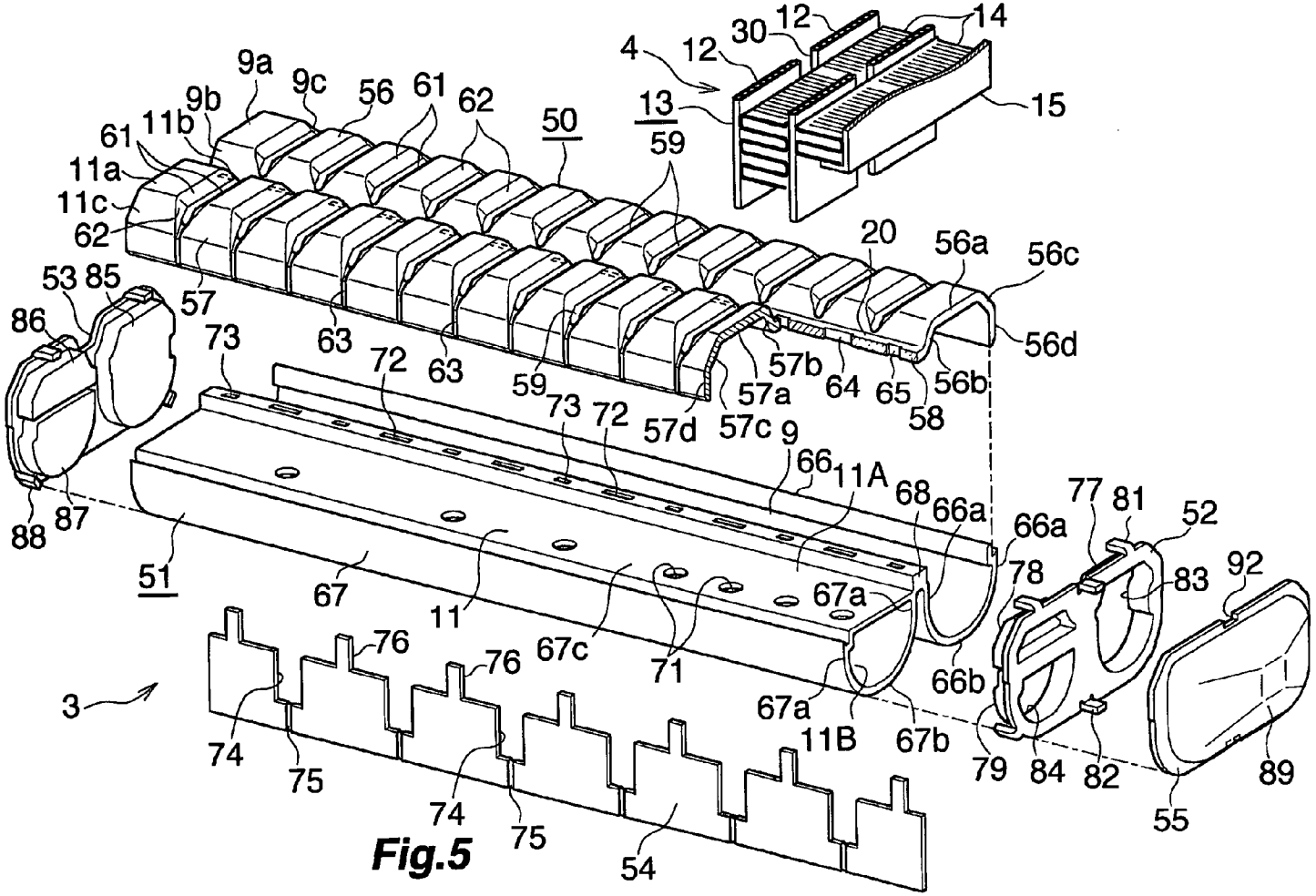
FIG. 5 is an exploded perspective view of a refrigerant turn tank of the evaporator shown in FIG. 1.
Figure 6:
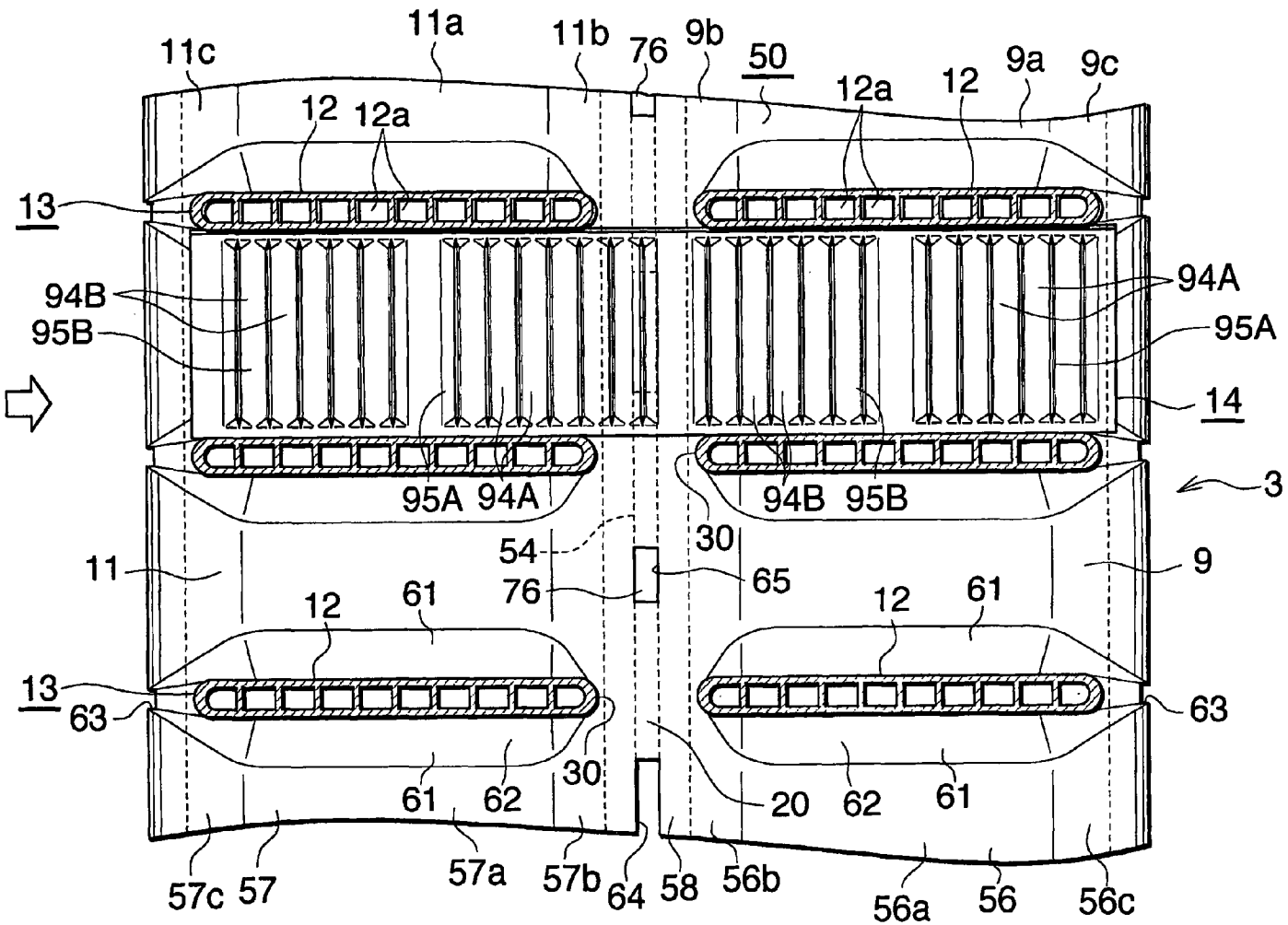
FIG. 6 is an enlarged fragmentary view in section taken along line B-B of FIG. 4.
Figure 7:
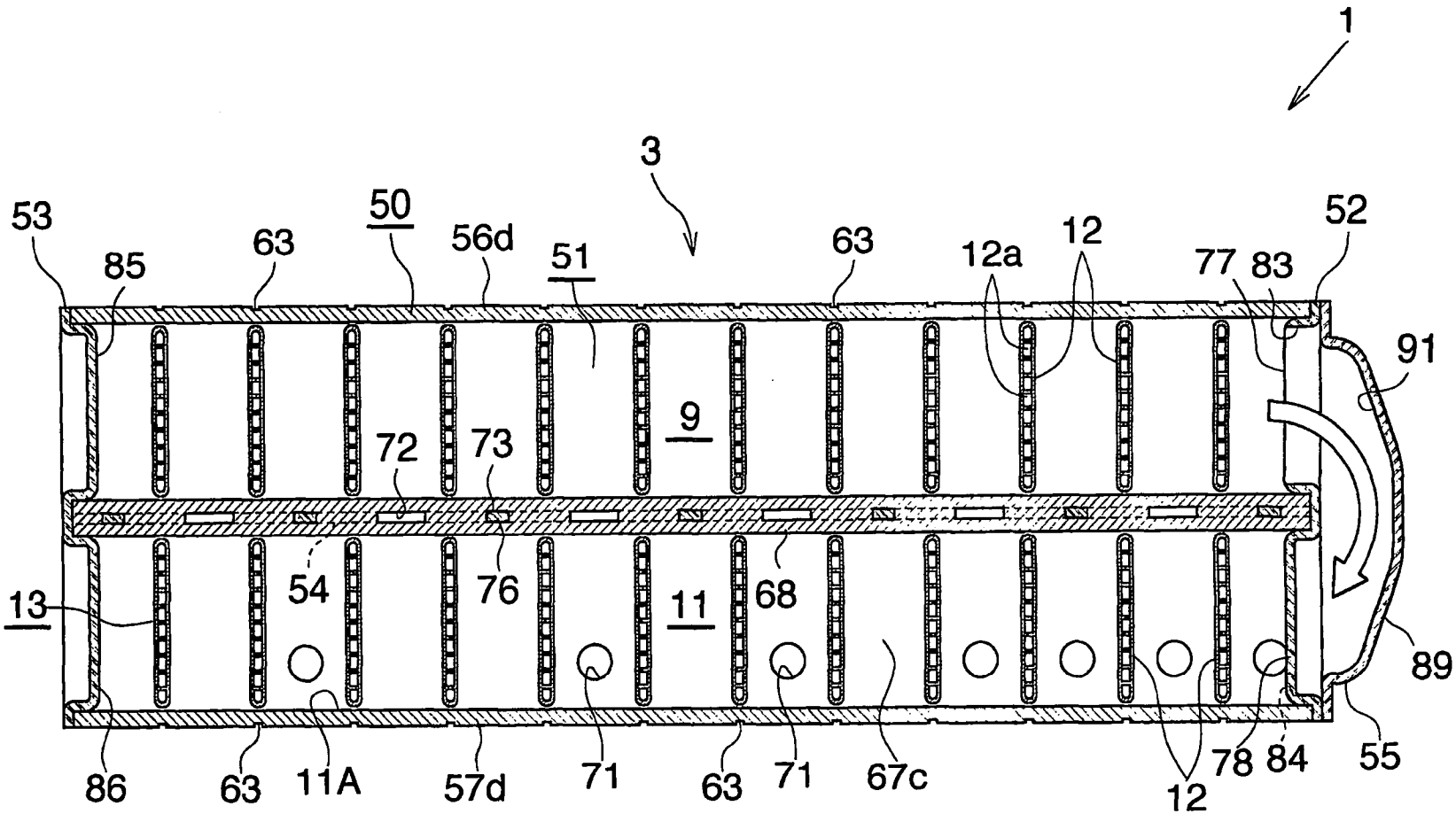
FIG. 7 is an enlarged fragmentary view in section taken along line C-C of FIG. 2.
Figure 8:
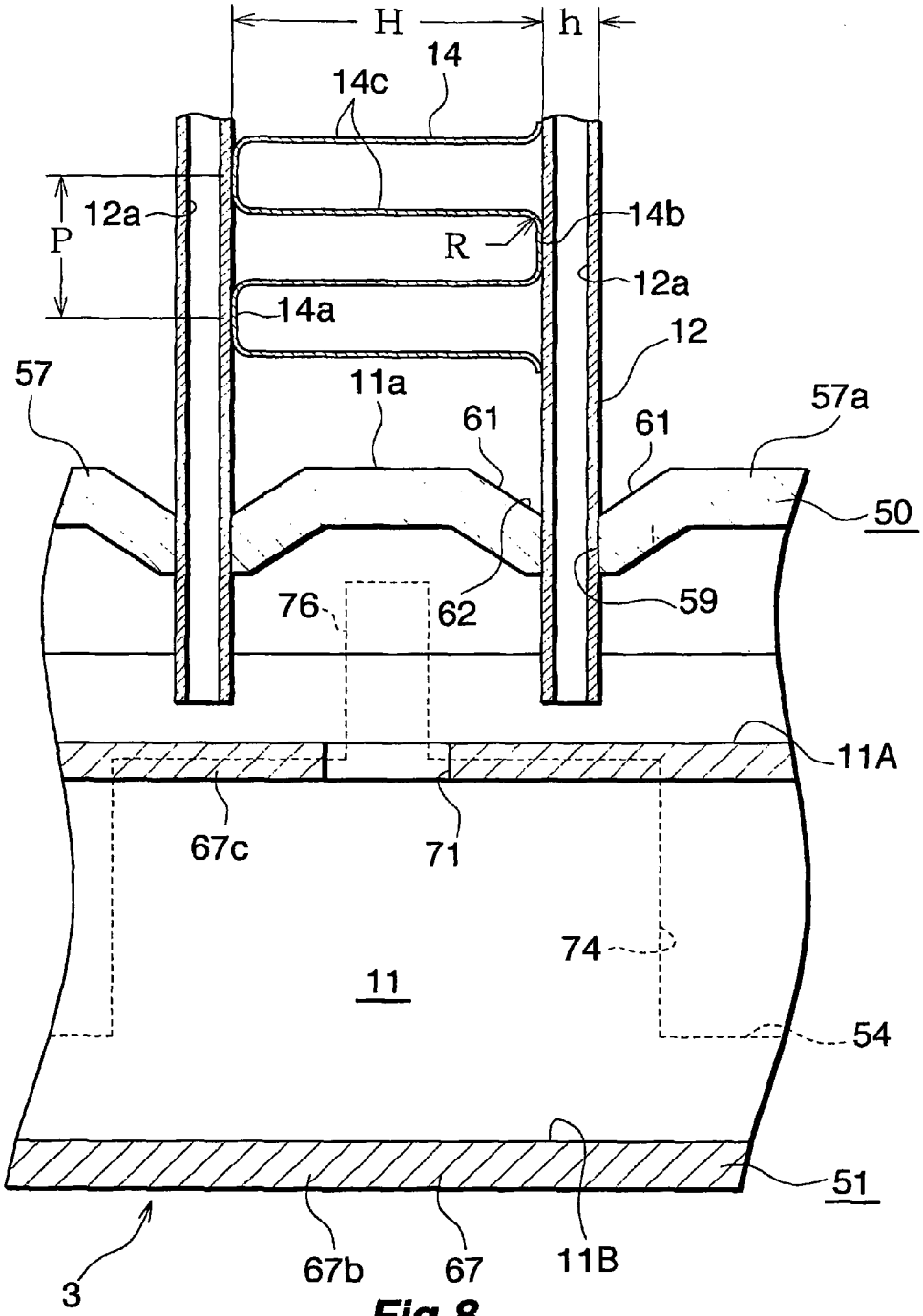
FIG. 8 is a partial enlarged view of FIG. 2.

As shown in FIG. 3, the refrigerant inlet/outlet tank (2) is formed from an aluminum brazing sheet having a brazing material layer on each of opposite sides thereof, and includes a first member (16) having a plate-like shape and to which the flat tubes (12) are connected; a second member (17) formed from a bare aluminum extrudate and covering the upper side of the first member (16); and caps (18) and (19) formed from an aluminum brazing sheet having a brazing material layer on each of opposite sides thereof, and joined to the opposite ends of the first and second members (16) and (17) to thereby close the left and right end openings. A joint plate (21) made of aluminum and elongated in the front-rear direction is brazed to the outer surface of the right-hand cap (19) while facing the respective ends of the refrigerant inlet header section (5) and the refrigerant outlet header section (6). The refrigerant inlet pipe (7) and the refrigerant outlet pipe (8) are connected to the joint plate (21).

The first member (16) has front and rear curved portions (22), whose central regions each have an arcuate cross section projecting downward and having a small curvature. A plurality of tube insertion holes (23), which are elongated in the front-rear direction, are formed in the curved portions (22) at predetermined intervals in the left-right direction. The tube insertion holes (23) of the front curved portion (22) and those of the rear curved portion (22) are identical in position in the left-right direction. A rising wall (22*a*) is formed integrally with each of the front edge of the front curved portion (22) and the rear edge of the rear curved portion (22), over the entire length of the front and rear edges. A plurality of through holes (25) are formed in a flat portion (24) located between the curved portions (22) of the first member (16), at predetermined intervals in the left-right direction.

The second member (17) includes front and rear walls (26) extending in the left-right direction and jointly forming a cross section resembling the letter m, which opens downward; a partition wall (27) (partition means) provided at a central region thereof between the front and rear walls (26), extending in the left-right direction, and dividing the interior of the refrigerant inlet/outlet tank (2) into a front space and a rear space; and two substantially arcuate connection walls (28) projecting upward and integrally connecting the upper end of the partition wall (27) and the upper ends of the front and rear walls (26). A flow-dividing resistance plate (29) integrally connects a lower end portion of the rear wall (26) of the second member (17) and a lower end portion of the partition wall (27) over the entire length thereof. A plurality of refrigerant passage holes (31A) and (31B) in a through-hole form and elongated in the left-right direction are formed in a rear region, excluding left and right end portions thereof, of the flow-dividing resistance plate (29) at predetermined intervals in the left-right direction. The lower end of the partition wall (27) projects downward beyond the lower ends of the front and rear walls (26). A plurality of projections (27*a*) are integrally formed on the lower end face of the partition wall (27) at predetermined intervals in the left-right direction in such a manner as to project downward, and are fitted into corresponding through holes (25) of the first member (16). The projections (27*a*) are formed by cutting off predetermined portions of the partition wall (27).

A leftward projecting portion (32) to be fitted into the refrigerant inlet header section (5) is formed integrally with the right-hand cap (19), on the side toward the front. An upper, leftward projecting portion (33) and a lower, leftward projecting portion (34) are formed integrally with the right-hand cap (19), on the side toward the rear, and spaced apart from each other in the vertical direction. The upper, leftward projecting portion (33) is fitted into a space (6*a*) of the refrigerant outlet header section (6), the space (6*a*) being located above the flow-dividing resistance plate (29). The lower, leftward projecting portion (34) is fitted into a space (6*b*) of the refrigerant outlet header section (6), the space (6*b*) being located under the flow-dividing resistance plate (29). An engagement finger (35) projecting leftward is formed integrally with each of an arcuate portion extending between the front side edge and the top edge of the right-hand cap (19) and an arcuate portion extending between the rear side edge and the top edge of the right-hand cap (19). Further, an engagement finger (36) projecting leftward is formed integrally with each of a front portion and a rear portion of the lower end face of the right-hand cap (19). A refrigerant inlet (37) is formed in the bottom wall of the leftward projecting portion (32), located on the side toward the front, of the right-hand cap (19). A refrigerant outlet (38) is formed in the bottom wall of the upper, leftward projecting portion (33), located on the side toward the rear, of the right-hand cap (19). The left-hand cap (18) is a mirror image of the right-hand cap (19) and includes the following integrally formed portions: a rightward projecting portion (39) to be fitted into the refrigerant inlet header section (5); an upper, rightward projecting portion (41) to be fitted into the space (6*a*) of the refrigerant outlet header section (6), the space (6*a*) being located above the flow-dividing resistance plate (29); a lower, rightward projecting portion (42) to be fitted into the space (6*b*) of the refrigerant outlet header section (6), the space (6*b*) being located under the flow-dividing resistance plate (29); and upper and lower engagement fingers (43) and (44) projecting rightward. No opening is formed in the bottom walls of the rightward projecting portion (39) and the upper, rightward projecting portion (41).

The joint plate (21) includes a short, cylindrical refrigerant inflow port (45) communicating with the refrigerant inlet (37) of the right-hand cap (19), and a short, cylindrical refrigerant outflow port (46) communicating with the refrigerant outlet (38) of the right-hand cap (19). A bent portion (47) projecting leftward is formed at a portion of each of the upper and lower edge portions of the joint plate (21) located between the refrigerant inflow port (45) and the refrigerant outflow port (46). The upper bent portion (47) is fitted to a central portion, with respect to the front-rear direction, of the upper edge of the right-hand cap (19) and is fitted between the two connection walls (28) of the second member (17). The lower bent portion (47) is fitted to a central portion, with respect to the front-rear direction, of the lower edge of the right-hand cap (19) and to the flat portion (24) of the first member (16). An engagement finger (48) projecting leftward is formed integrally with each of front and rear end portions of the lower edge of the joint plate (21). The engagement fingers (48) are fitted to the lower edge of the right-hand cap (19). A diameter-reduced portion formed at one end portion of the refrigerant inlet pipe (7) is inserted into and brazed to the refrigerant inflow port (45) of the joint plate (21). Similarly, a diameter-reduced portion formed at one end portion of the refrigerant outlet pipe (8) is inserted into and brazed to the refrigerant outflow port (46) of the joint plate (21). Although unillustrated, an expansion valve attachment member is joined to the other end portions of the refrigerant inlet and outlet pipes (7) and (8) while facing the ends of the pipes (7) and (8).

The first and second members (16) and (17) of the refrigerant inlet/outlet tank (2), the caps (18) and (19), and the joint plate (21) are brazed together as follows. In assembly of the first and second members (16) and (17), the projections (27*a*) of the second member (17) are inserted into the corresponding through holes (25) of the first member (16), followed by crimping. As a result, upper end portions of the front and rear rising walls (22*a*) of the first member (16) are fitted to corresponding lower end portions of the front and rear walls (26) of the second member (17). In the thus-established condition, the first and second members (16) and (17) are brazed together by utilization of the brazing material layers of the first member (16). In attachment of the caps (18) and (19), the front projecting portions (39) and (32) are fitted into the space defined by the first and second members (16) and (17) and located frontward of the partition wall (27); the rear, upper projecting portions (41) and (33) are fitted into the space defined by the first and second members (16) and (17) and located rearward of the partition wall (27) and above the flow-dividing resistance plate (29); the rear, lower projecting portions (42) and (34) are fitted into the space defined by the first and second members (16) and (17) and located rearward of the partition wall (17) and under the flow-dividing resistance plate (29); the upper engagement fingers (43) and (35) are fitted to the connection walls (28) of the second member (17); and the lower engagement fingers (44) and (36) are fitted to the curved portions (22) of the first member (16). In the thus-established condition, the caps (18) and (19) are brazed to the first and second members (16) and (17) by utilization of the brazing material layers thereof. In attachment of the joint plate (21), the bent portions (47) are fitted to the right-hand cap (19) and the second member (17), and the engagement fingers (48) are fitted to the right-hand cap (19). In the thus-established condition, the joint plate (21) is brazed to the right-hand cap (19) by utilization of the brazing material layers of the right-hand cap (19).

The refrigerant inlet/outlet tank (2) is thus formed. A portion of the refrigerant inlet/outlet tank (2) located frontward of the partition wall (27) of the second member (17) serves as the refrigerant inlet header section (5), and a portion of the refrigerant inlet/outlet tank (2) located rearward of the partition wall (27) serves as the refrigerant outlet header section (6). The flow-dividing resistance plate (29) divides the interior of the refrigerant outlet header section (6) into the upper and lower spaces (6*a*) and (6*b*). The spaces (6*a*) and (6*b*) communicate with each other through the refrigerant passage holes (31A) and (31B). The refrigerant outlet (38) of the right-hand cap (19) communicates with the upper space (6*a*) of the refrigerant outlet header section (6). The refrigerant inflow port (45) of the joint plate (21) communicates with the refrigerant inlet (37), and the refrigerant outflow port (46) communicates with the refrigerant outlet (38).

As shown in FIGS. 4 to 8, the refrigerant turn tank (3) is formed from an aluminum brazing sheet having a brazing material layer on each of opposite sides thereof and includes a first member (50) having a plate-like shape and to which the flat tubes (12) are connected; a second member (51) formed from a bare aluminum extrudate and covering the lower side of the first member (50); caps (52) and (53) formed from an aluminum brazing sheet having a brazing material layer on each of opposite sides thereof, and closing the left and right end openings of the first and second members (50) and (51); an auxiliary drain plate (54) formed from an aluminum bare material, elongated in the left-right direction, and joined to the connection section (10); and a communication member (55) formed from an aluminum bare material, elongated in the front-rear direction, and brazed to the outer surface of the right-hand cap (52) in such a manner as to face the ends of the refrigerant inflow header section (9) and the refrigerant outflow header section (11). The refrigerant inflow header section (9) and the refrigerant outflow header section (11) communicate with each other at their right end portions via the communication member (55).

Each of the refrigerant inflow header section (9) and the refrigerant outflow header section (11) has a top face, a front side face, a rear side face, and a bottom face. The top faces, excluding their inside and outside portions with respect to the front-rear direction, of the header sections (9) and (11) serve as horizontal flat faces (9*a*) and (11*a*), respectively. The inside portions with respect to the front-rear direction of the top faces of the header sections (9) and (11) serve as first low portions (9*b*) and (11*b*), respectively, which are of faces inclined linearly downward and toward the inside with respect to the front-rear direction. The first low portions (9*b*) and (11*b*) serve as front and rear side surfaces of the drain gutter (20). The front and rear side surfaces of the drain gutter (20) fan out upward and in the front-rear direction. Preferably, the first low portions (9*b*) and (11*b*) are inclined downward at an angle of 45 degrees or greater with respect to a horizontal plane. The front and rear side surfaces of the drain gutter (20); i.e., the first low portions (9*b*) and (11*b*) of the header sections (9) and (11), are not necessarily inclined linearly, but may be curved, so long as they fan out upward and in the front-rear direction. Outside portions with respect to the front-rear direction of the top faces of the header sections (9) and (11) serve as second low portions (9*c*) and (11*c*), respectively, which are of faces inclined linearly downward and toward the outside with respect to the front-rear direction. Preferably, the second low portions (9*c*) and (11*c*) are inclined downward at an angle of 45 degrees or greater with respect to a horizontal plane. The front and rear outside surfaces of the header sections (9) and (11) are connected to the corresponding second low portions (9*c*) and (11*c*) of the top faces.

The first member (50) includes a first header formation portion (56), which forms an upper portion of the refrigerant inflow header section (9); a second header formation portion (57), which forms an upper portion of the refrigerant outflow header section (11); and a connection wall (58), which connects the header formation portions (56) and (57) and forms the connection section (10). The first header formation portion (56) includes a horizontal flat top wall (56*a*); a first inclined wall (56*b*), which is formed integrally with the rear edge of the top wall (56*a*) over the entire length thereof and inclined rearward and downward; a second inclined wall (56*c*), which is formed integrally with the front edge of the top wall (56*a*) over the entire length thereof and inclined frontward and downward; and a vertical wall (56*d*), which is formed integrally with the front edge of the second inclined wall (56*c*) over the entire length thereof. The second header formation portion (57) includes a horizontal flat top wall (57*a*); a first inclined wall (57*b*), which is formed integrally with the front edge of the top wall (57*a*) over the entire length thereof and inclined frontward and downward; a second inclined wall (57*c*), which is formed integrally with the rear edge of the top wall (57*a*) over the entire length thereof and inclined rearward and downward; and a vertical wall (57*d*), which is formed integrally with the rear edge of the second inclined wall (57*c*) over the entire length thereof. The connection wall (58) integrally connects the lower edge of the first inclined wall (56*b*) of the first header formation portion (56) and the lower edge of the first inclined wall (57*b*) of the second header formation portion (57). The bottom end faces of the vertical walls (56*d*) and (57*d*) of the header formation portions (56) and (57), respectively, are inclined downward, and inward with respect to the front-rear direction. An outside portion of each of the bottom faces partially forms a stepped portion (69), which will be described later. The upper surface of the top wall (56*a*) of the first header formation portion (56) serves as the top face of the refrigerant inflow header section (9); i.e., as the horizontal flat face (9*a*); the outer surfaces of the inclined walls (56*b*) and (56*c*) serve as the low portions (9*b*) and (9*c*); and the outer surface of the vertical wall (56*c*) serves as an upper portion of the front surface of refrigerant inflow header section (9). The upper surface of the top wall (57*a*) of the second header formation portion (57) serves as the top face of the refrigerant outflow header section (11); i.e., as the horizontal flat face (11*a*); the upper surfaces of the inclined walls (57*b*) and (57*c*) serve as the low portions (11*b*) and (11*c*); and the outer surface of the vertical wall (57*d*) serves as an upper portion of the rear surface of the refrigerant outflow header section (11).

A plurality of tube insertion holes (59) elongated in the front-rear direction are formed in the header formation portions (56) and (57) of the first member (50) at predetermined intervals in the left-right direction. The tube insertion holes (59) of the header formation portion (56) and those of the header formation portion (57) are identical in position in the left-right direction. End portions, located on a side toward the connection section (10), of the tube insertion holes (59); i.e., rear end portions of the tube insertion holes (59) of the first header formation portion (56) and front end portions of the tube insertion holes (59) of the second header formation portion (57), are located in the first inclined walls (56*b*) and (57*b*), respectively. Thus, the end portions, located on the side toward the connection section (10), of the tube insertion holes (59) are located in the side surfaces of the drain gutter (20). Outer end portions, with respect to the front-rear direction, of the tube insertion holes (59); i.e., front end portions of the tube insertion holes (59) of the first header formation portion (56) and rear end portions of the tube insertion holes (59) of the second header formation portion (57), are located in the second inclined walls (56*c*) and (57*c*), respectively. Thus, the front and rear end portions of the tube insertion holes (59) are located in the second low portions (9*c*) and (11*c*) of the top faces of the header sections (9) and (11).

In the top walls (56*a*) and (57*a*) and the inclined walls (56*b*), (56*c*), (57*b*), and (57*c*) of the header formation portions (56) and (57) of the first member (50), their portions located on the left and right sides of each tube insertion hole (59) serve as inclined portions (61) that are inclined downward and toward the tube insertion hole (59). The inclined portions (61) located on the left and right sides of each tube insertion hole (59) define a recess (62). Drain grooves (63) for draining condensed water downward of the refrigerant turn tank (3) are formed, in connection with the front and rear end portions of the corresponding tube insertion holes (59), on the outer surfaces of the second inclined walls (56*c*) and (57*c*) and the vertical walls (56*d*) and (57*d*) of the header formation portions (56) and (57) of the first member (50). The bottom of each drain groove (63) extends downward as the distance from the corresponding tube insertion hole (59) increases. The bottom of a portion of each drain groove (63) located on the second inclined wall (56*c*) or (57*c*); i.e., on the second low portion (9*c*) or (11*c*), is linearly inclined, with respect to a horizontal plane, downward and toward the front or the rear. Preferably, the bottom of the portion of each drain groove (63) located on the second low portion (9*c*) or (11*c*) is inclined at an angle of 45 degrees or greater with respect to the horizontal plane. The lower end of a portion of each drain groove (63) located on the vertical wall (56*d*) or (57*d*) opens at the bottom end face of the vertical wall (56*d*) or (57*d*).

A plurality of drain through-holes (64) elongated in the left-right direction are formed in the connection wall (58) of the first member (50) at predetermined intervals in the left-right direction. Also, a plurality of fixation though-holes (65) are formed in the connection wall (58) of the first member (50) at predetermined intervals in the left-right direction while being shifted from the drain through-holes (64).

The first member (50) is formed, by press work, from an aluminum brazing sheet in such a manner as to form the header formation portions (56) and (57); i.e., the top walls (56*a*) and (57*a*), the inclined walls (56*b*), (56*c*), (57*b*), and (57*c*), the vertical walls (56*d*) and (57*d*), the connection wall (58), the tube insertion holes (59), the inclined portions (61), and the drain grooves (63), and to form the drain through-holes (64) and the fixation through-holes (65) in the connection wall (58).

The second member (51) includes a first header formation portion (66), which forms a lower portion of the refrigerant inflow header section (9); a second header formation portion (67), which forms a lower portion of the refrigerant outflow header section (11); and a connection wall (68), which connects together the header formation portions (66) and (67) and is brazed to the connection wall (58) of the first member (50) to thereby form the connection section (10). The first header formation portion (66) includes vertical front and rear walls (66*a*), and a bottom wall (66*b*) integrally connecting the bottom ends of the front and rear walls (66*a*), projecting downward, and having a substantially arcuate cross section. The second header formation portion (67) includes vertical front and rear walls (67*a*); a bottom wall (67*b*) integrally connecting the bottom ends of the front and rear walls (67*a*), projecting downward, and having a substantially arcuate cross section; and a horizontal flow-dividing control wall (67*c*) integrally connecting upper end portions of the front and rear walls (67*a*). The connection wall (68) integrally connects an upper end portion of the rear wall (66*a*) of the first header formation portion (66) and an upper end portion of the front wall (67*a*) of the second header formation portion (67). The outer surface of the front wall (66*a*) of the first header formation portion (66) and the outer surface of the rear wall (67*a*) of the second header formation portion (67) are located inward, with respect to the front-rear direction, of the outer surface of the vertical wall (56*d*) of the first header formation portion (56) and the outer surface of the vertical wall (57*d*) of the second header formation portion (57), respectively, of the first member (50). Thus, the stepped portion (69) is provided at each of joint portions between the vertical walls (56*d*) and (57*d*) of the first member (50) and the front and rear walls (66*a*) and (67*a*) of the second member (51); the outer surfaces of the vertical walls (56*d*) and (57*d*) are located outward, with respect to the front-rear direction, of the outer surfaces of the front and rear walls (66*a*) and (67*a*), respectively, via the corresponding stepped portions (69); and the entire bottom end of each drain groove (63) opens at the corresponding stepped portion (69) (see FIG. 4). The outer surface of an upper edge portion of the front wall (66*a*) of the first header formation portion (66) is flush with the bottom surface of a portion of the drain groove (63) located on the vertical wall (56*d*), and the outer surface of an upper edge portion of the rear wall (67*a*) of the second header formation portion (67) is flush with the bottom surface of a portion of the drain groove (63) located on the vertical wall (57*d*). The outer surface of the front wall (66*a*) of the first header formation portion (66) serves as a lower portion of the front surface of the refrigerant inflow header section (9). The outer surface of the rear wall (67*a*) of the second header formation portion (67) serves as a lower portion of the rear surface of the refrigerant outflow header section (11).

A plurality of circular refrigerant passage holes (71) in a through-hole form are formed in a rear region of the flow-dividing control wall (67*c*) of the second header formation portion (67) of the second member (51) at predetermined intervals in the left-right direction. The distance between the two adjacent circular refrigerant passage holes (71) increases gradually as the distance from the left end of the flow-dividing control wall (67*c*) increases. Notably, the distance between the two adjacent circular refrigerant passage holes (71) may be constant. A plurality of through holes (72) elongated in the left-right direction are formed in the connection wall (68) of the second member (51), in alignment with the corresponding drain through-holes (64) of the first member (50). Also, a plurality of fixation through-holes (73) are formed in the connection wall (68), in alignment with the corresponding fixation through-holes (65) of the first member (50).

The second member (51) is formed as follows. First, the front and rear walls (66*a*) and (67*a*) and the bottom walls (66*b*) and (67*b*) of the header formation portions (66) and (67), the flow-dividing control wall (67*c*) of the second header formation portion (67), and the connection wall (68) are integrally formed by extrusion. Subsequently, the resultant extrudate is subjected to press work so as to form the refrigerant passage holes (71) in the flow-dividing control wall (67*c*), and the drain through-holes (72) and the fixation through-holes (65) in the connection wall (68).

Cutouts (74) are formed in the auxiliary drain plate (54) in such a manner as to extend from its upper edge and to correspond to the drain through-holes (64) and (72) of the first and second members (50) and (51). The width of an open portion of the cutout (74) as measured in the left-right direction is equal to the length of the drain through-holes (64) and (72) as measured in the left-right direction. Auxiliary drain grooves (75) are formed on the front and rear surfaces of the auxiliary drain plate (54) as follows: the auxiliary drain grooves (75) extend vertically and are connected to the corresponding lower end portions of the cutouts (74); and their lower end portions are open at the bottom face of the auxiliary drain plate (54). Projections (76) are formed at the top edge of the auxiliary drain plate (54) in such a manner as to align with the corresponding fixation through-holes (65) and (73) of the first and second members (50) and (51) and to project upward so as to be inserted into the corresponding fixation through-holes (65) and (73). The auxiliary drain plate (54) is formed, by press work, from an aluminum bare material in such a manner as to form the cutouts (74), the auxiliary drain grooves (75), and the projections (76).

The caps (52) and (53) assume a plate-like form and are formed, by press work, from an aluminum brazing sheet having a brazing material layer on each of opposite sides thereof. A leftward projecting portion (77) to be fitted into the refrigerant inflow header section (9) is formed integrally with the right-hand cap (52), on the side toward the front. An upper, leftward projecting portion (78) and a lower, leftward projecting portion (79) are formed integrally with the right-hand cap (52), on the side toward the rear, and spaced apart from each other in the vertical direction. The upper, leftward projecting portion (78) is fitted into a space (11A) of the refrigerant outflow header section (11), the space (11A) being located above the flow-dividing control wall (67*c*). The lower, leftward projecting portion (79) is fitted into a space (11B) of the refrigerant outflow header section (11), the space (11B) being located under the flow-dividing control wall (67*c*). In the right-hand cap (52), an engagement finger (81) projecting leftward is formed integrally with each of an arcuate portion extending between the front side edge and the bottom edge and an arcuate portion extending between the rear side edge and the bottom edge, and is also formed integrally with the top edge at front and rear positions; and further, an engagement finger (82) projecting rightward is formed on each of the upper and lower edges at a central position with respect to the front-rear direction. Through holes (83) and (84) are formed in the bottom wall of the front, leftward projecting portion (77) and the bottom wall of the rear, lower, leftward projecting portion (79), respectively, of the right-hand cap (52). The front through hole (83) establishes communication between the interior and the exterior of the refrigerant inflow header section (9). The rear through hole (84) establishes communication between the interior and the exterior of the space (11B), located under the flow-dividing control wall (67*c*), of the refrigerant outflow header section (11).

A rightward projecting portion (85) to be fitted into the refrigerant inflow header section (9) is formed integrally with the left-hand cap (53), on the side toward the front. An upper, rightward projecting portion (86) and a lower, rightward projecting portion (87) are formed integrally with the left-hand cap (53), on the side-toward the rear, and spaced apart from each other in the vertical direction. The upper, rightward projecting portion (86) is fitted into the space (11A) of the refrigerant outflow header section (11), the space (11A) being located above the flow-dividing control wall (67*c*). The lower, rightward projecting portion (87) is fitted into the space (11B) of the refrigerant outflow header section (11), the space (11B) being located under the flow-dividing control wall (67*c*). In the left-hand cap (53), an engagement finger (88) projecting rightward is formed integrally with each of an arcuate portion extending between the front side edge and the bottom edge, and an arcuate portion extending between the rear side edge and the bottom edge, and is also formed integrally with the top edge at front and rear positions. No through hole is formed in the bottom walls of the rightward projecting portion (85) and the lower, rightward projecting portion (87).

The communication member (55) is formed, by press work, from an aluminum bear material and assumes, as viewed from the right, a plate-like form identical with that of the right-hand cap (52). A peripheral edge portion of the communication member (55) is brazed to the outer surface of the right-hand cap (52). An outward bulging portion (89) is formed on the communication member (55) so as to establish communication between the two through holes (83) and (84) of the right-hand cap (52). The interior of the outward bulging portion (89) serves as a communication channel (91) for establishing communication between the through holes (83) and (84) of the right-hand cap (52). A cutout (92) is formed on each of the upper and lower edges of the communication member (55) at a central position with respect to the front-rear direction. The engagement fingers (82) of the right-hand cap (52) are fitted into the corresponding cutouts (92).

In assembly of the refrigerant turn tank (3), the first and second members (50) and (51), the auxiliary drain plate (54), the caps (52) and (53), and the communication member (55) are brazed together as follows. In assembly of the first member (50) and the second member (51), the connection walls (58) and (68) are brought in contact with each other such that the drain through-holes (64) and (72) are aligned with each other and such that the fixation through-holes (65) and (73) are aligned with each other; the bottom ends of the vertical walls (56*d*) and (57*d*) of the header formation portions (56) and (57) are engaged with the corresponding top ends of the front wall (66*a*) of the first header formation portion (66) and the rear wall (67*a*) of the second header formation portion (67); and the projections (76) of the auxiliary drain plate (54) are inserted from underneath into the fixation through-holes (65) and (73) of the members (50) and (51) and then crimped, thereby tacking the members (56) and (57) together. In the thus-established condition, these members are brazed together by utilization of the brazing material layers of the first member (50). The auxiliary drain plate (54) is brazed to the connection walls (58) and (68) of the members (50) and (51) by utilization of the brazing material layers of the first member (50). In attachment of the caps (52) and (53), the front projecting portions (77) and (85) are fitted into the space defined by the first header formation portions (56) and (66) of the members (50) and (51); the rear, upper projecting portions (78) and (86) are fitted into the upper space defined by the second header formation portions (57) and (67) of the members (50) and (51) and located above the flow-dividing control wall (67*c*); the rear, lower projecting portions (79) and (87) are fitted into the lower space defined by the second header formation portions (57) and (67) of the members (50) and (51) and located under the flow-dividing control wall (67*c*); the upper engagement fingers (81) and (88) are fitted to the first member (50); and the lower engagement fingers (81) and (88) are fitted to the second member (51). In the thus-established condition, the caps (52) and (53) are brazed to the first and second members (50) and (51) by utilization of the brazing material layers thereof. In attachment of the communication member (55), the communication member (55) is engaged with the right-hand cap (52) such that the engagement fingers (82) are fitted into the corresponding cutouts (92). In the thus-established condition, the communication member (55) is brazed to the right-hand cap (52) by utilization of the brazing material layers of the right-hand cap (52).

The refrigerant turn tank (3) is thus formed. The first header formation portions (56) and (66) of the members (50) and (51) define the refrigerant inflow header section (9). The second header formation portions (57) and (67) define the refrigerant outflow header section (11). The flow-dividing control wall (67*c*) divides the interior of the refrigerant outflow header section (11) into the upper and lower spaces (11A) and (11B). The spaces (11A) and (11B) communicate with each other through the circular refrigerant passage holes (71). The rear through hole (84) of right-hand cap (52) communicates with the lower space (11B) of the refrigerant outflow header section (11). The interior of the refrigerant inflow header section (9) and the lower space (11B) of the refrigerant outflow header section (11) communicate with each other via the through holes (83) and (84) of the right-hand cap (52) and the communication channel (91) in the outward bulging portion (89) of the communication member (55). The connection walls (58) and (68) of the members (50) and (51) define the connection section (10). The first low portion (9*b*) of the refrigerant inflow header section (9), the first low portion (11*b*) of the refrigerant outflow header section (11), and the connection section (10) define the drain gutter (20).

Each of the flat tubes (12) is formed from a bare aluminum extrudate and assumes a flat form having a wide width in the front-rear direction. In the flat tube (12), a plurality of refrigerant channels (12*a*) extending in the longitudinal direction thereof are formed in parallel therein. The front flat tubes (12) and the rear flat tubes (12) are arranged in such a manner as to be identical in position in the left-right direction. Upper end portions of the flat tubes (12) are inserted into the corresponding tube insertion holes (23) of the first member (16) of the refrigerant input/output tank (2) and brazed to the first member (16) by utilization of the brazing material layers of the first member (16). Lower end portions of the flat tubes (12) are inserted into the corresponding tube insertion holes (59) of the first member (50) of the refrigerant turn tank (3) and brazed to the first member (50) by utilization of the brazing material layers of the first member (50). The front flat tubes (12) communicate with the refrigerant inlet header section (5) and the refrigerant inflow header section (9). The rear flat tubes (12) communicate with the refrigerant outlet header section (6) and the refrigerant outflow header section (11).

Preferably, the thickness of the flat tube (12) as measured in the left-right direction; i.e., a tube height (h), is 0.75 mm to 1.5 mm (see FIG. 8); the width of the flat tube (12) as measured in the front-rear direction is 12 mm to 18 mm; the wall thickness of the flat tube (12) is 0.175 mm to 0.275 mm; the thickness of a partition wall separating the refrigerant channels (12*a*) from each other is 0.175 mm to 0.275 mm; the pitch of the partition walls is 0.5 mm to 3.0 mm; and the front and rear end walls each have a radius of curvature of 0.35 mm to 0.75 mm as measured on the outer surface thereof.

In place of use of the flat tube (12) formed from an aluminum extrudate, a flat tube to be used may be formed such that an inner fin is inserted into a seam welded pipe of aluminum so as to form a plurality of refrigerant channels therein. Alternatively, a flat tube to be used may be formed as follows. An aluminum brazing sheet having a brazing material layer on each of opposite sides thereof is subjected to a rolling process so as to form a plate that includes two flat-wall-forming portions connected together via a connection portion; side-wall-forming portions, which are formed, in a bulging condition, integrally with the corresponding flat-wall-forming portions at their side edges located in opposition to the connection portion; and a plurality of partition-wall-forming portions, which are formed integrally with the flat-wall-forming portions in such a manner as to project from the flat-wall-forming portions, and to be arranged at predetermined intervals in the width direction of the flat-wall-forming portions. The thus-prepared plate is bent at the connection portion into a hairpin form such that the side-wall-forming portions abut each other, followed by brazing. The partition-wall-forming portions become partition walls.

Each of the corrugated fins (14) is made in a wavy form from an aluminum brazing sheet having a brazing material layer over opposite surfaces thereof. The corrugate fin (14) includes wave crest portions (14*a*), wave trough portions (14*b*), and horizontal flat connection portions (14*c*) each connecting together the wave crest portion (14*a*) and the wave trough portion (14*b*) (see FIG. 8). A plurality of louvers (94A) and (94B) are formed at the connection portions (14*c*) in such a manner as to be juxtaposed in the front-rear direction. The front and rear flat tubes (12) that constitute the refrigerant flow member (13) share the corrugate fin (14). The width of the corrugate fin (14) as measured in the front-rear direction is approximately equal to the span between the front edge of the front flat tube (12) and the rear edge of the rear flat tube (12). The wave crest portions (14*a*) and the wave trough portions (14*b*) of the corrugate fin (14) are brazed to the front and rear flat tubes (12) that constitute the refrigerant flow member (13). In each of the connection portions (14*c*) of the corrugate fin (14), a first louver group (95A) composed of a plurality of first louvers (94A) which incline downward toward the front and a second louver group (95B) composed of a plurality of second louvers (94B) which incline upward toward the front are alternately formed. The first louver group (95A) is formed to correspond to a front portion of each flat tube (12), and the second louver group (95B) is formed to correspond to a rear portion of each flat tube (12). At least the front-end first louver (94A) of the first louver group (95A) corresponding to the front portion of the rear flat tube (12) is located between the flat tubes (12) adjacently located in the front-rear direction; i.e., in the drain portion (30) of the refrigerant flow member (13) (see FIG. 4). At each connection portion (14*c*), the corrugate fin (14) has a flat portion between the adjacent louver groups (95A) and (95B).

The fin height (H) of the corrugate fin (14) is the direct distance between the wave crest portion (14*a*) and the wave trough portion (14*b*), and the fin height (H) is preferably 7.0 mm to 10.0 mm. Further, the fin pitch (Pf) of the corrugate fin (14) is half the vertical interval (P) between the central portions (with respect to the vertical direction) of the adjacent wave crest portions (14*a*) or the adjacent wave trough portions (14*b*) (i.e., Pf=P/2), and the fin pitch (Pf) is preferably 1.3 mm to 1.8 mm. Each of the wave crest portion (14*a*) and the wave trough portion (14*b*) of the corrugate fin (14) includes a flat portion, which is brazed in a surface contact condition to the flat tubes (12), and round portions, which are located at corresponding opposite ends of the flat portion and connected to the corresponding connection portions (14*c*). Preferably, the round portions have a radius (R) of curvature of 0.7 mm or less (see FIG. 8).

In manufacture of the evaporator (1), component members thereof excluding the refrigerant inlet pipe (7) and the refrigerant outlet pipe (8) are assembled and provisionally fixed together, and then all the component members are brazed together.

The evaporator (1), together with a compressor and a condenser, constitutes a refrigeration cycle which is installed in a vehicle, for example, an automobile, as a car air conditioner.

In the evaporator (1) described above, as shown in FIG. 9, two-phase refrigerant of vapor-liquid phase having passed through a compressor, a condenser, and an expansion valve enters the refrigerant inlet header section (5) of the refrigerant inlet/outlet tank (2) from the refrigerant inlet pipe (7) through the refrigerant inflow port (45) of the joint plate (21) and the refrigerant inlet (37) of the right-hand cap (19). Then, the refrigerant dividedly flows into the refrigerant channels (12*a*) of all of the front flat tubes (12).

The refrigerant having entered the refrigerant channels (12*a*) of all the front flat tubes (12) flows downward through the refrigerant channels (12*a*) and enters the refrigerant inflow header section (9) of the refrigerant turn tank (3). The refrigerant having entered the refrigerant inflow header section (9) flows rightward and then flows through the front through hole (83) of the right-hand cap (52), the communication channel (91) in the outward bulging portion (89) of the communication member (55), and the rear through hole (84) of the right-hand cap (52), thereby turning its flow direction and entering the lower space (11B) of the refrigerant outflow header (11).

Even when the distribution of temperature (dryness of refrigerant) of the refrigerant flowing through the front flat tubes (12) becomes nonuniform due to a failure in the refrigerant flowing from the refrigerant inlet header section (5) to the front flat tubes (12) in a uniformly divided condition, the refrigerant is mixed up when the refrigerant outflowing from the refrigerant inflow header section (9) turns its flow direction and flows into the lower space (11B) of the refrigerant outflow header section (11), so that its temperature becomes uniform.

The refrigerant having entered the lower space (11B) of the refrigerant outflow header section (11) flows leftward; enters the upper space (11A) through the circular refrigerant passage holes (71) of the flow-dividing control wall (67*c*); and dividedly flows into the refrigerant channels (12*a*) of all of the rear flat tubes (12).

The refrigerant having flown into the refrigerant channels (12) of the flat tubes (12) flows upward, in opposition to the previous flow direction; enters the lower space (6*b*) of the refrigerant outlet header section (6); and enters the upper space (6*a*) through the elongated refrigerant passage holes (31A) and (31B) of the flow-dividing resistance plate (29). Since the flow-dividing control wall (29) impart resistance to the flow of the refrigerant, the divided flow from the upper space (11A) of the refrigerant outflow header section (11) to the rear flat tubes (12) becomes uniform, and the divided flow from the refrigerant inlet header section (5) to the front flat tubes (12) becomes uniform to a greater extent. As a result, the refrigerant flow rate becomes uniform among all the flat tubes (12), so that the temperature distribution throughout the heat exchange core section (4) becomes uniform.

Next, the refrigerant having entered the upper space (6*a*) of the refrigerant outlet header section (6) flows out to the-refrigerant outlet pipe (8) through the refrigerant outlet (38) of the right-hand cap (19) and the refrigerant outflow port (46) of the joint plate (21). While flowing through the refrigerant channels (12*a*) of the front flat tubes (12) and through the refrigerant channels (12*a*) of the rear flat tubes (12), the refrigerant is subjected to heat exchange with the air flowing through the air-passing clearances in the direction of arrow X shown in FIGS. 1 and 9 and flows out from the evaporator (1) in a vapor phase.

At this time, condensed water is produced on the flat tubes (12) and on the surface of the corrugate fins (14). The produced condensed water mostly flows, by the capillary effect, toward joint portions between the flat tubes (12) and the wave crest portions (14*a*) of the corrugate fins (14) and toward joint portions between the flat tubes (12) and the wave trough portions (14*b*) of the corrugate fins (14), then flows forward along the joint portions because of air passing through the air-passing clearances. Subsequently, the water flows downward along the front end surface of each rear flat tube (12) facing the corresponding drain portion (30), and also flows downward along the front end surface of each front flat tube (12). However, if at least the front-end first louver (94A) of the first louver group (95A), which is provided to correspond to the front portion of each rear flat tube (12), is not located in the drain portion (30) of the corresponding refrigerant flow member (13), the condensed water may flow frontward while passing through the drain portion (30) along portions of the connection portions (14*c*) of the corrugate fin (14) where the louvers (94A) and (94B) are not formed, which may result in a drop in draining performance when the quantity of the produced condensed water is large. In contrast, in the case where at least the front-end first louver (94A) of the first louver-group (95A), which is provided to correspond to the front portion of each rear flat tube (12), is located in the drain portion (30) of the corresponding refrigerant flow member (13), the condensed water flows downward through a clearance between the first louver (94A) located in the drain portion (30) of the corresponding refrigerant flow member (13) and the first louver (94A) adjacently located on the rear side thereof. Therefore, the condensed water produced on the surface of the corrugate fin (14) is prevented from flowing forward while passing through the drain portion (30). Accordingly, a drop in draining performance can be prevented even when the quantity of the produced condensed water is large.

Condensed water drained from the corrugate fins (14) flows down onto the refrigerant inflow header section (9) and the refrigerant outflow header section (11) of the refrigerant turn tank (3). A portion of the condensed water having flown down onto the refrigerant turn tank (3) enters the drain gutter (20). When the condensed water collected in the drain gutter (20) reaches a certain amount, the condensed water flows down the connection section (10) through the drain holes (64) and (72); flows along side edge portions of the cutouts (74) of the auxiliary drain plate (54); enters the auxiliary drain grooves (75); flows down in the auxiliary drain grooves (75); and drops downward below the refrigerant turn tank (3) from the bottom end openings of the auxiliary drain grooves (75). The remaining condensed water enters the drain grooves (63); flows in the drain grooves (63); and drops downward below the refrigerant turn tank (3) from the bottom end openings of the drain grooves (63); i.e., from the openings of the stepped portions (69).

The above mechanism prevents freezing of condensed water which could otherwise result from stagnation of condensed water in a large amount in the regions between the bottom ends of the corrugate fins (14) and the horizontal flat faces (9*a*) and (11*a*) of the header sections (9) and (11) of the refrigerant turn tank (3). As a result, a drop in performance of the evaporator (1) is prevented.

In the above-described Embodiment 1, communication between the refrigerant inflow header section (9) of the refrigerant turn header tank (3) and the lower space (11B) of the refrigerant outflow header section (11) is established at the end portion where the refrigerant inlet (37) of the refrigerant inlet header section (5) is provided. However, alternatively, such communication may be established at the end portion opposite the refrigerant inlet (37).

Embodiment 2

The present embodiment is illustrated in FIGS. 10 to 13.

In the present embodiment, the evaporator (100) is configured such that a plurality of refrigerant flow members (101) each having a vertically elongated rectangular shape are arranged in a laminated condition in the left-right direction and joined together while their widths extend in the front-rear direction (air flow direction).

Each of the refrigerant flow members (101) includes two vertically extending rectangular aluminum plates (102) whose peripheral edge portions are brazed together. Each of the aluminum plates (102) is formed from an aluminum brazing, sheet having a brazing material layer on each of opposite sides thereof. Two (front and rear) vertically extending, bulging refrigerant flow tube portions (103) and (104), and bulging header formation portions (105) and (106) are provided between the two aluminum plates (102), which partially constitute the refrigerant flow member (101). The bulging header formation portions (105) and (106) are connected to corresponding upper and lower end portions of the refrigerant flow tube portions (103) and (104). An aluminum corrugate inner fin (107) is disposed in each of the refrigerant flow members (101) in such a manner as to extend across the front and rear refrigerant flow tube portions (103) and (104). The corrugate inner fin (107) is brazed to the aluminum plates (102). Notably, two aluminum corrugate inner fins may be disposed separately in the corresponding refrigerant flow tube portions (103) and (104). A drain groove (108) (drain portion) extending vertically and adapted to drain condensed water is formed in a portion of the outer surface of the refrigerant flow member (101), the portion being sandwiched between the front and rear refrigerant flow tube portions (103) and (104).

The right-hand aluminum plate (102) used to partially constitute the refrigerant flow member (101) includes two (front and rear) vertically extending, rightward bulging, tube-portion-forming bulging portions (109) and four rightward bulging, header-forming bulging portions (110) connected to the corresponding upper and lower ends of the tube-portion-forming bulging portions (109) and having a bulging height greater than that of the tube-portion-forming bulging portions (109). A portion of the right-hand side surface of the right-hand aluminum plate (102) sandwiched between the two tube-portion-forming bulging portions (109) serves as the drain groove (108). A through-hole (111) is formed in the top wall of each of the header-forming bulging portions (110). The left-hand aluminum plate (102) used to partially constitute the refrigerant flow member (101) is a mirror image of the right-hand aluminum plate (102). The header formation portions (105) and (106) of the adjacent two refrigerant flow members (101) are brazed together such that the through-holes (111) of the header formation portions (105) and (106) of one of the adjacent refrigerant flow members (101) communicate with those of the header formation portions (105) and (106) of the other refrigerant flow member (101). Thus, the header formation portions (105) and (106) of the adjacent refrigerant flow members (101) are respectively joined together in a communicating condition, so that upper and lower heads (112) communicating with the front refrigerant flow tube portions (103) and upper and lower headers (113) communicating with the rear refrigerant flow tube portions (103) are formed. A clearance is formed between the upper headers (112) and (113) and between the lower headers (112) and (113), and the clearance between the lower headers (112) and (113) serves as a drain clearance.

In the refrigerant flow members (101), the height of the header formation portions (105) and (106) in the left-right direction is greater than that of the refrigerant flow tube portions (103) and (104). Clearances between the refrigerant flow tube portions (103) and clearances between the refrigerant flow tube portions (104) of the adjacent refrigerant flow members (101) serve as air-passing clearances. The corrugate fins (14) similar to those of Embodiment 1 are disposed in the corresponding air-passing clearances in such a manner as to be shared between the refrigerant flow tube portions (103) and (104). The wave crest portions (14*a*) and the wave trough portions (14*b*) of each corrugate fin (14) are brazed to the outer surfaces of the refrigerant flow tube portions (103) and (104). The first louver group (95A) of each corrugate fin (14) is formed to correspond to a front portion of each of the refrigerant flow tube portions (103) and (104), and the second louver group (95B) is formed to correspond to a rear portion of each of the refrigerant flow tube portions (103) and (104). At least the front-end first louver (94A) of the first louver group (95A) corresponding to the front portion of the rear refrigerant flow tube portions (104) is located at a position corresponding to the drain groove (108).

Preferably, the thickness of the refrigerant flow tube portions (103) and (104) of the refrigerant flow member (101) as measured in the left-right direction; i.e., the tube height (h1), is 0.75 mm to 1.5 mm (see FIG. 13); the width as measured in the front-rear direction; i.e., the tube width, is 12 mm to 18 mm; and the wall thickness of the aluminum plate (102) is 0.175 mm to 0.275 mm.

Notably, the fin height (H) and fin pitch (Pf) of the corrugate fin (14) are the same as those in Embodiment 1.

In manufacture of the evaporator (100), component members thereof are assembled and fixed provisionally, and all the component members brazed together.

In the evaporator (100) of the present embodiment, the flow of refrigerant is optimized by means of blocking communication via the through-hole (111) between two predetermined adjacent refrigerant flow members (101).

In the evaporator (100) of the present embodiment, when condensed water is produced on the refrigerant flow tube portions (103) and (104) and on the surface of the corrugate fins (14), the produced condensed water mostly flows, by the capillary effect, toward joint portions between the refrigerant flow tube portions (103) and (104) and the wave crest portions (14*a*) of the corrugate fins (14) and toward joint portions between the refrigerant flow tube portions (103) and (104) and the wave trough portions (14*b*) of the corrugate fins (14), then flows forward along the joint portions because of air passing through the air-passing clearances. Subsequently, the water flows downward along the front end surface of each rear refrigerant flow tube portion (104) facing the corresponding drain groove (108), and also flows downward along the front end surface of each front refrigerant flow tube portion (103). Moreover, since at least the front-end first louver (94A) of the first louver group (95A), which is provided to correspond to the front portion of each rear refrigerant flow tube portion (104), is located in the drain groove (108) of the corresponding refrigerant flow member (101), the condensed water flows also downward through the clearance between the first louver (94A) located in the drain groove (108) of the refrigerant flow member (101) and the first louver (94A) adjacently located on the rear side thereof. Therefore, the condensed water produced on the surfaces of the corrugate fins (14) is prevented from flowing forward while passing through the drain groove (108). Accordingly, a drop in draining performance can be prevented even when the quantity of the produced condensed water is large.

The above two embodiments are described while mentioning the evaporator applied to an evaporator of a car air conditioner that uses a chlorofluorocarbon-based refrigerant. However, the present invention is not limited thereto. The evaporator of the present invention may be applied to an evaporator of a car air conditioner used in a vehicle, for example, an automobile, the car air conditioner including a compressor, a gas cooler, an intermediate heat exchanger, an expansion valve, and an evaporator, and using a supercritical refrigerant such as a $CO_2$ refrigerant.

INDUSTRIAL APPLICABILITY

The evaporator of the present invention is favorably used as an evaporator for use in a car air conditioner, which is a refrigeration cycle of, for example, an automobile.

The invention claimed is:

1. An evaporator comprising:

a plurality of refrigerant flow members arranged in parallel at predetermined intervals in a left-right direction, and a plurality of corrugate fins disposed in air-passing clearances between the refrigerant flow members, wherein each of refrigerant flow members includes a plurality of refrigerant flow tube portions arranged in a front-rear direction, each of the corrugate fins is disposed to extend across the refrigerant flow tube portions, a drain portion which is vertically extending is formed between the refrigerant flow tube portions adjacent each other in the front-rear direction, each of the corrugate fins includes wave crest portions, wave trough portions, and connection portions connecting the wave crest portions and the wave trough portions, each of the corrugate fins has a plurality of first louvers and a plurality of second louvers arranged in the front-rear direction at each of the connection portions, the plurality of first louvers is inclining downward toward a front of the refrigerant flow tube portions in the front-rear direction and is provided to correspond to a front portion of each of the refrigerant flow tube portions, the plurality of second louvers is inclining upward toward the front of the refrigerant flow tube portions in the front-rear direction and is formed to correspond to a rear portion of each of the refrigerant flow tube portions, at least a front-end louver of the plurality of first louvers is provided to correspond to the front portion of each of the refrigerant flow tube portions except for a refrigerant flow tube portion at a front end is located in the drain portion, and clearances between the plurality of second louvers in the front-rear direction is provided to correspond to the rear portion of each of the refrigerant flow tube portions except for a refrigerant flow tube portion at a rear end are not facing the drain portion.

2. An evaporator according to claim 1, wherein each of the corrugate fins has a fin height of 7.0 mm to 10.0 mm and a fin pitch of 1.3 mm to 1.8 mm.

3. An evaporator according to claim 1, wherein each of the wave crest portions and the wave trough portions in each of the corrugate fins comprise a flat portion and round portions located at corresponding opposite ends of the flat portion and connected to the connection portions, and the round portions have a radius of curvature of 0.7 mm or less.

4. An evaporator according to claim 1, wherein each of the refrigerant flow tube portions comprises a plurality of flat tubes arranged in tandem in the front-rear direction and includes a plurality of tube groups arranged in a plurality of rows at predetermined intervals in the front-rear direction, each of the tube groups has a group of flat tubes among the plurality of flat tubes arranged in parallel at predetermined intervals in the left-right direction, each of the flat tubes serves as a refrigerant flow tube portion, the corrugate fins are brazed to the flat tubes, and a clearance between the flat tubes adjacent each other in the front-rear direction serves as the drain portion.

5. An evaporator according to claim 4 wherein a tube height, which is a thickness of each of the flat tubes as measured in the left-right direction, is 0.75 mm to 1.5 mm.

6. An evaporator according to claim 4, further comprising:

a refrigerant inlet header section which is disposed on a side toward the front and on a first-end side of the refrigerant flow members and to which the flat tubes of at least one of the tube groups are connected;

a refrigerant outlet header section which is disposed on the first-end side of the refrigerant flow members and rearward of the refrigerant inlet header section and to which the flat tubes of remaining tube groups among the tube groups are connected;

a first intermediate header section which is disposed on the side toward the front and on a second-end side of the refrigerant flow members and to which the flat tubes connected to the refrigerant inlet header section are connected; and a second intermediate header section which is disposed on the second-end side of the refrigerant flow members and rearward of the first intermediate header section and to which the flat tubes connected to the refrigerant outlet header section are connected, wherein the first and second intermediate header sections communicate with each other.

7. An evaporator according to claim 6, wherein the first and second intermediate header sections are integrated.

8. An evaporator according to claim 7, wherein a drain gutter extending in the left-right direction is provided on an upper surface of a portion between the first and second intermediate header sections at a location corresponding to the drain portion.

9. An evaporator according to claim 1, wherein each of the refrigerant flow members is formed of two metal plates whose peripheral edge portions are joined together, a plurality of bulging refrigerant flow tube portions arranged in the front-rear direction are formed between the two metal plates, a bulging header formation portion is connectedly formed at each of opposite ends of the bulging refrigerant flow tube portions, a plurality of the refrigerant flow members are laminated such that the bulging header formation portions abut each other and such that air-passing clearances are formed between the bulging refrigerant flow tube portions, and a corrugate fin of the corrugate fins is disposed in each air-passing clearance between adjacent refrigerant flow members among the refrigerant flow members and brazed to the refrigerant flow members.

10. An evaporator according to claim 9, wherein the drain portion between the refrigerant flow tube portions adjacent each other in the front-rear direction comprises a groove formed by inwardly deforming the two metal plates that constitute a corresponding refrigerant flow member of the refrigerant flow members.

11. An evaporator according to claim 9, wherein a tube portion height, which is a thickness of each of the bulging refrigerant flow tube portions as measured in the left-right direction, is 0.75 mm to 1.5 mm.

* * * * *